US009284139B2

(12) United States Patent
Otsuka et al.

(10) Patent No.: US 9,284,139 B2
(45) Date of Patent: Mar. 15, 2016

(54) SHEET FEEDING DEVICE AND IMAGE FORMING APPARATUS

(71) Applicant: FUJI XEROX CO., LTD., Tokyo (JP)

(72) Inventors: Yuji Otsuka, Kanagawa (JP); Yoshiyuki Kitazawa, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/607,422

(22) Filed: Jan. 28, 2015

(65) Prior Publication Data

US 2015/0220054 A1 Aug. 6, 2015

(30) Foreign Application Priority Data

Feb. 3, 2014 (JP) ..... 2014-018799

(51) Int. Cl.
*B65H 3/08* (2006.01)
*B65H 3/12* (2006.01)
*B65H 7/16* (2006.01)

(52) U.S. Cl.
CPC ..... *B65H 3/08* (2013.01); *B65H 3/0816* (2013.01); *B65H 3/0833* (2013.01); *B65H 3/12* (2013.01); *B65H 7/16* (2013.01); *B65H 2406/36* (2013.01)

(58) Field of Classification Search
CPC ..... B65H 3/08; B65H 3/0816; B65H 3/0833; B65H 3/0883; B65H 7/16; B65H 2406/30; B65H 2406/31; B65H 2406/36; B65H 2406/363; B65H 3/12
USPC ..... 271/90, 95, 96, 108
See application file for complete search history.

(56) References Cited

U.S. PATENT DOCUMENTS

| | | | | |
|---|---|---|---|---|
| 5,478,066 | A * | 12/1995 | Yoshida et al. | 271/12 |
| 5,645,274 | A * | 7/1997 | Ubayashi et al. | 271/94 |
| 6,398,207 | B1 * | 6/2002 | Taylor et al. | 271/106 |
| 2013/0020755 | A1 * | 1/2013 | Kitazawa et al. | 271/108 |
| 2013/0026698 | A1 * | 1/2013 | Ikeuchi et al. | 271/11 |

FOREIGN PATENT DOCUMENTS

JP 2002-19978 A 1/2002

* cited by examiner

*Primary Examiner* — Davi H Bollinger
(74) *Attorney, Agent, or Firm* — Sughrue Mion, PLLC

(57) ABSTRACT

A sheet feeding device includes an attracting mechanism and a changing mechanism. The attracting mechanism includes a lifting section and a maintaining section. The lifting section attracts a portion of a sheet material that is fed and lifts the portion of the sheet material. The maintaining section attracts an edge of the sheet material that is lifted by the lifting section and maintains an orientation of the edge of the sheet material. The changing mechanism changes at least one of an attraction force that is generated at the lifting section and an attraction force that is generated at the maintaining section.

18 Claims, 20 Drawing Sheets

FIG. 5

| SHEET TYPE | SHEET SIZE | BASIS WEIGHT [g/m$^2$] | CLASS |
|---|---|---|---|
| ORDINARY SHEET | POSTCARD TO A4 | 52 TO 300 | CLASS 2 |
| | | 301 TO 400 | CLASS 1 |
| | A4 TO A3 | 52 TO 250 | CLASS 2 |
| | | 251 TO 400 | CLASS 1 |
| | SIZE LARGER THAN A3 PAPER SIZE (ONE SIZE LARGER THAN A3) | 52 TO 220 | CLASS 2 |
| | | 221 TO 400 | CLASS 1 |
| COATED SHEET | POSTCARD TO A4 | 64 TO 80 | CLASS 3 |
| | | 81 TO 300 | CLASS 2 |
| | | 301 TO 400 | CLASS 1 |
| | A4 TO A3 | 64 TO 80 | CLASS 3 |
| | | 81 TO 250 | CLASS 2 |
| | | 251 TO 400 | CLASS 1 |
| | SIZE LARGER THAN A3 PAPER SIZE (ONE SIZE LARGER THAN A3) | 64 TO 105 | CLASS 3 |
| | | 106 TO 220 | CLASS 2 |
| | | 221 TO 400 | CLASS 1 |
| ENVELOPE | ALL | ALL | CLASS 3 |

SHEET FEEDING DEVICE AND IMAGE FORMING APPARATUS

CROSS-REFERENCE TO RELATED APPLICATIONS

This application is based on and claims priority under 35 USC 119 from Japanese Patent Application No. 2014-018799 filed Feb. 3, 2014.

BACKGROUND

Technical Field

The present invention relates to a sheet feeding device and an image forming apparatus.

SUMMARY

According to an aspect of the invention, there is provided a sheet feeding device including an attracting mechanism and a changing mechanism. The attracting mechanism includes a lifting section and a maintaining section. The lifting section attracts a portion of a sheet material that is fed and lifts the portion of the sheet material. The maintaining section attracts an edge of the sheet material that is lifted by the lifting section and maintains an orientation of the edge of the sheet material. The changing mechanism changes at least one of an attraction force that is generated at the lifting section and an attraction force that is generated at the maintaining section.

BRIEF DESCRIPTION OF THE DRAWINGS

Exemplary embodiments of the present invention will be described in detail based on the following figures, wherein:

FIG. 5 is a table of classifications, such as sheet type, which is used in controlling the sheet feeding device according to the first exemplary embodiment of the present invention;

DETAILED DESCRIPTION

A sheet feeding device 70 and an image forming apparatus 10 according to an exemplary embodiment of the present invention are described with reference to FIGS. 1 to 15. In these figures, the direction of arrow Y indicates a vertical direction, that is, an up-down direction of the sheet feeding device 70 and the image forming apparatus 10; the direction of arrow X indicates a horizontal direction, that is, a width direction of the sheet feeding device 70 and the image forming apparatus 10; and the direction of arrow Z indicates a horizontal direction, that is, a depth direction of the sheet feeding device 70 and the image forming apparatus 10.

Overall Structure of Image Forming Apparatus

Figure 15:
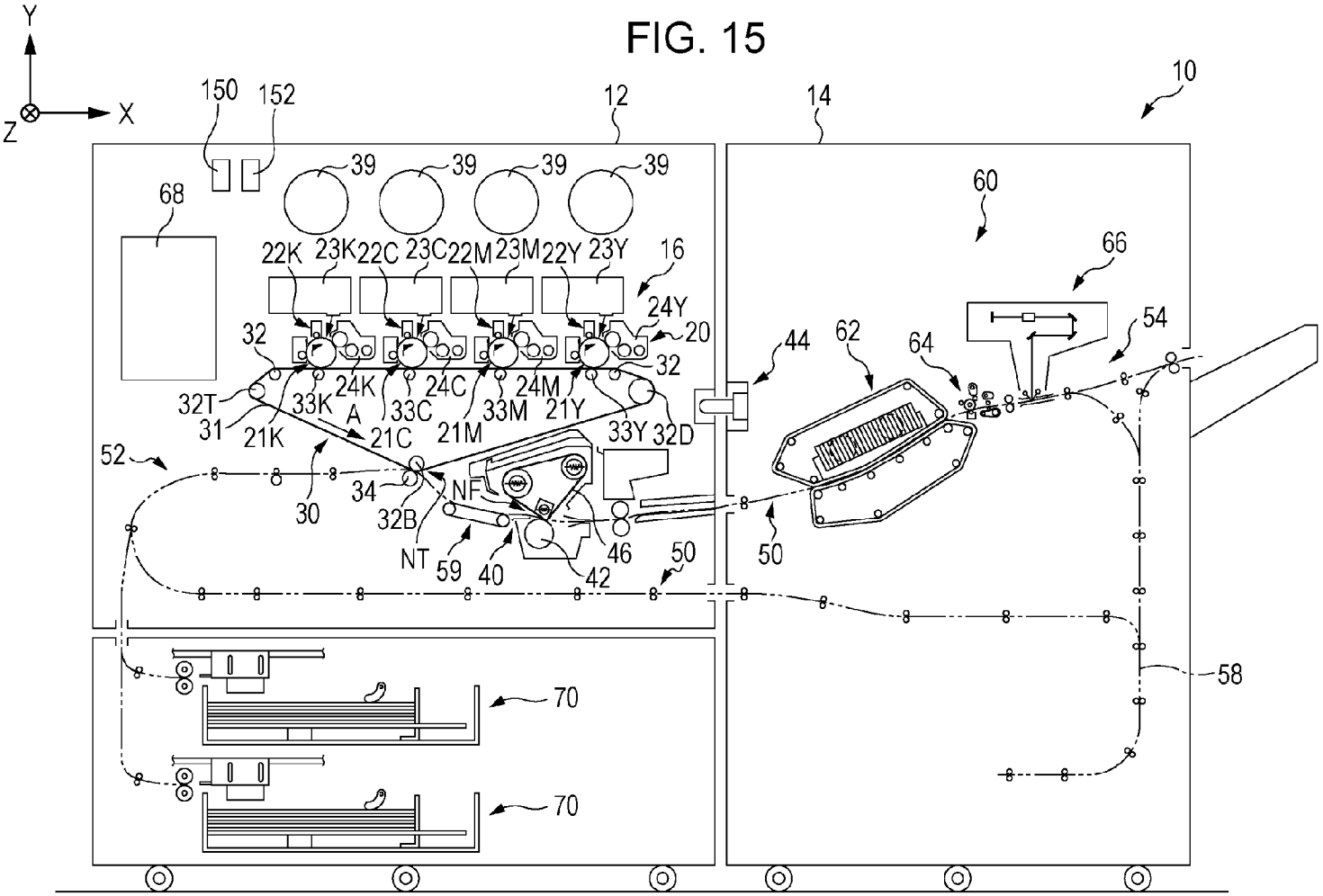
FIG. 15 is a schematic view of a structure of the image forming apparatus according to the first exemplary embodiment of the present invention.

As shown in FIG. 15, the image forming apparatus 10 includes a first housing 12, a second housing 14, an image forming unit 16, a medium transporting section 50, a post-processing unit 60, and a controller 68. The controller 68 controls each portion of the image forming apparatus 10 (such as each portion of the image forming unit 16).

The first housing 12 and the second housing 14 are disposed side by side in the width direction of the image forming apparatus 10, and are connected to each other with a connecting mechanism 44.

Image Forming Unit 16

Figure 14:
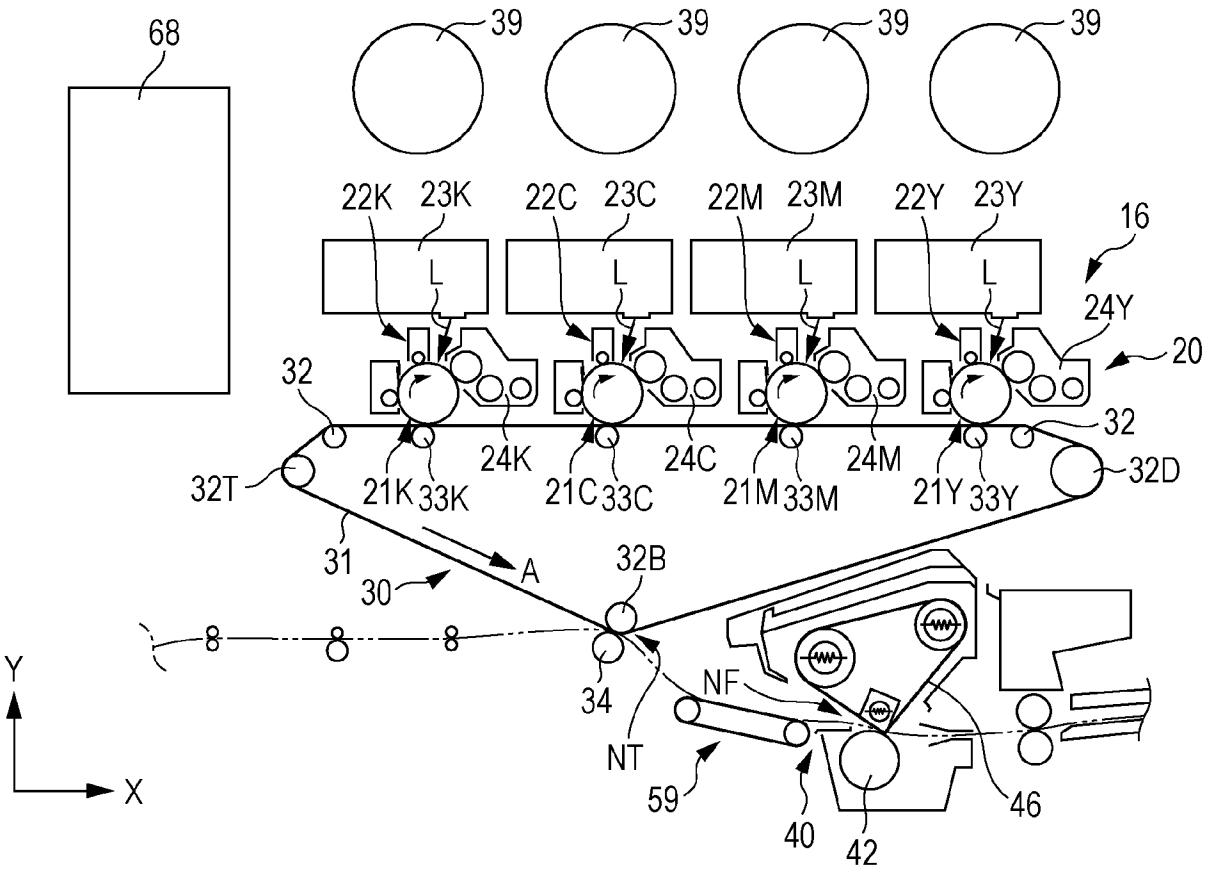
FIG. 14 shows a structure of, for example, toner image forming sections of the image forming apparatus according to the first exemplary embodiment of the present invention.

The image forming unit 16 is disposed in the first housing 12. As shown in FIG. 14, the image forming unit 16 includes toner image forming sections 20, a transfer device 30, and a fixing device 40. Each toner image forming section 20 forms a toner image. The transfer device 30 transfers the image formed by each toner image forming section 20 to a sheet material P serving as a recording medium. The fixing device 40 fixes each toner image transferred to the sheet material P to the sheet material P. The image forming unit 16 forms the images on the sheet material P by an electrophotographic system.

Toner Image Forming Section 20

Each toner image forming section 20 includes a photoconductor drum 21, which is an image bearing member, a charging unit 22, an exposure device 23, and a developing device 24. The toner image forming sections 20 are provided for forming the toner images of respective colors. In the exemplary embodiment, the toner image forming sections 20 that are provided are those for four colors, that is, yellow (Y), magenta (M), cyan (C), and black (K), respectively. The toner image forming sections 20 for the respective colors have the same structure. From an upstream side in a circumferential direction of a transfer belt 31 of the transfer device 30, the photoconductor drum 21 of the toner image forming section 20 for yellow (Y), the photoconductor drum 21 of the toner image forming section 20 for magenta (M), the photoconductor drum 21 of the toner image forming section 20 for cyan (C), and the photoconductor drum 21 of the toner image forming section 20 for black (K) contact the transfer belt 31 in that order. The toner image forming sections 20 for the respective colors are disposed side by side in the width direction of the image forming apparatus 10. When the toner image forming sections 20 need not be distinguished, the reference characters Y, M, C, and K are sometimes omitted.

Each photoconductor drum 21 has a cylindrical shape, and is rotationally driven around its own axis by a driving unit (not shown). An outer peripheral surface of each photoconductor drum 21 is provided with, for example, a photosensitive layer having a negative charging polarity.

Each charging unit 22 contacts the outer peripheral surface (photosensitive layer) of its corresponding photoconductor drum 21, and charges the outer peripheral surface of its corresponding photoconductor drum 21 to a negative polarity while being driven and rotated by its corresponding photoconductor drum 21 that rotates.

Each exposure device 23 forms an electrostatic latent image on the outer peripheral surface of its corresponding photoconductor drum 21. More specifically, in accordance with image data received from an image signal processor of the controller 68, modulated exposure light beams L illuminate the outer peripheral surfaces of the respective photoconductor drums 21 that have been charged by the respective charging units 22. By the illuminations using the exposure light beams L, the electrostatic latent images are formed on the outer peripheral surfaces of the respective photoconductor drums 21.

In the exemplary embodiment, each exposure device 23 is formed so that the light beam emitted from a light source (not shown) exposes the outer peripheral surface of its corresponding photoconductor drum 21 while the light beam scans its corresponding photoconductor drum 21 using a light scanner (optical system) including a polygon mirror and an Fθ lens.

Each developing device 24 develops the electrostatic latent image formed on the outer peripheral surface of its corresponding photoconductor drum 21 into a toner image using developer G containing toner T and a carrier CA, to form the toner image on the outer peripheral surface of its corresponding photoconductor drum 21. A powder container 39 (toner cartridge) for replenishing its corresponding developing device 24 with toner T is connected to its corresponding developing device 24 via a transport path (not shown). The powder containers 39 for the respective colors are disposed side by side in the width direction of the image forming apparatus 10 above the respective exposure devices 23, and are individually removable (replaceable) with respect to the first housing 12.

The transfer device 30 includes the endless transfer belt 31 to which the toner images on the photoconductor drums 21 for the respective colors are transferred. The orientation of the transfer belt 31 is determined by winding the transfer belt 31 upon rollers 32. In the exemplary embodiment, as viewed from the front, the transfer belt 31 is oriented so as to form an inverted acute triangle and so as to be long in the width direction.

Of the rollers 32, the roller 32D functions as a driving roller that causes the transfer belt 31 to circulate in the direction of arrow A by driving force of a motor (not shown). Of the rollers 32, the roller 32T functions as a tension applying roller that applies tension to the transfer belt 31. Of the rollers 32, the roller 32B functions as a roller opposing a second transfer roller 34 (described below).

Further, first transfer rollers 33 that transfer the toner images that are formed on the outer peripheral surfaces of the respective photoconductor drums 21 are disposed opposite to the respective photoconductor drums 21 with the transfer belt 31 being interposed therebetween.

The second transfer roller 34 that transfers the toner images transferred to the transfer belt 31 to the sheet material P contacts an apex at a lower end of the acute triangle formed by the transfer belt 31. The transfer belt 31 and the second transfer roller 34 form a transfer nip NT.

The fixing device 40 fixes the toner images to the sheet material P to which the toner images have been transferred by the transfer device 30. In the exemplary embodiment, the fixing device 40 fixes the toner images to the sheet material P by pressing the toner images while heating the toner images at a fixing nip NF formed by a fixing belt 46 and a pressure roller 42.

Medium Transporting Section 50

As shown in FIG. 15, the medium transporting section 50 includes a medium supplying section 52 and a medium discharging section 54. The medium supplying section 52 supplies a sheet material P to the image forming unit 16. The sheet material P on which the images have been formed is discharged to the medium discharging section 54. The medium transporting section 50 also includes a medium returning section 58 and an intermediate transporting section 59. The medium returning section 58 is used when images are to be formed on both surfaces of the sheet material P. The intermediate transporting section 59 transports the sheet material P from the transfer device 30 to the fixing device 40.

The medium supplying section 52 includes sheet feeding devices 70 where sheet materials P are loaded. In accordance with a transfer timing at the transfer nip NT, the sheet materials that are loaded in the sheet feeding devices 70 are fed one by one to the transfer nip NT. The sheet feeding devices 70 are described in detail below.

The medium discharging section 54 discharges the sheet material P to which the toner images have been fixed at the fixing device 40 to the outside of the image forming apparatus 10. When images are to be formed on the other surface of the sheet material P to whose one surface the toner images have been fixed, the medium returning section 58 reverses the front and back of the sheet material P and returns the sheet material P to the image forming unit 16 (medium supplying section 52).

Post-Processing Unit 60

As shown in FIG. 15, the post-processing unit 60 is disposed in the second housing 14, and includes a medium cooling section 62, a straightening device 64, and an image inspecting section 66. The medium cooling unit 62 cools the sheet material P on which the images have been formed. The straightening device 64 straightens the sheet material P. The image inspecting section 66 inspects the images.

Each portion of the post-processing unit 60 is disposed in the medium discharging section 54 of the medium transporting section 50. The medium cooling section 62, the straightening device 64, and the image inspecting section 66 are disposed in that order from the upstream side in the direction in which the sheet materials P are discharged.

Image Formation Operation

Next, an outline of an image formation process in which images are formed on sheet materials P by the image forming apparatus 10 and a post-processing process is described.

The controller 68 that has received an image formation instruction causes the toner image forming sections 20, the transfer device 30, and the fixing device 40 to operate. By this, the photoconductor drums 21 and developing rollers (not shown) of the respective developing devices 24 are rotated, and the transfer belt 31 is circulated. Further, the pressure roller 42 is rotated, and the fixing belt 46 is circulated. Then, in synchronism with these operations, the controller 68 operates, for example, the medium transporting section 50.

The photoconductor drums 21 for the respective colors are charged by the respective charging units 22 while the photoconductor drums 21 rotate. The controller 68 sends to the exposure devices 23 for the respective colors image data that has been subjected to image processing at the image signal processor. The exposure devices 23 for the respective colors emit exposure light beams L for the respective colors that are in accordance with the image data, and expose the charged photoconductor drums 21 for the respective colors. This causes electrostatic latent images to be formed on the outer peripheral surfaces of the photoconductor drums 21 for the respective colors. The electrostatic latent images formed on the photoconductor drums 21 for the respective colors are developed as toner images using developer G that is supplied from each developing device 24. As a result, the toner images of the respective colors, yellow (Y), magenta (M), cyan (C), and black (K), are formed on the photoconductor drums 21 for the respective colors.

Further, the toner images of the respective colors formed on the photoconductor drums 21 for the respective colors are successively transferred onto the transfer belt 31 that is circulated by the first transfer rollers 33 for the respective colors. As a result, the toner images of the four colors that are superimposed upon each other are formed on the transfer belt 31. The superimposed toner images are transported to the transfer nip NT by circulating the transfer belt 31. In accordance with a timing in which the superimposed toner images are transported, a sheet material P is supplied to the transfer nip NT by the medium supplying section 52. By applying a transfer voltage to the second transfer roller 34 at the transfer nip NT, the toner images are transferred to the sheet material P from the transfer belt 31.

The sheet material P to which the toner images have been transferred is transported, while being attracted under negative pressure, towards the fixing nip NF of the fixing device 40 from the transfer nip NT of the transfer device 30 by the intermediate transporting section 59. The fixing device 40 applies heat and pressing force (fixing energy) to the sheet material P that passes the fixing nip NF. This causes the toner images that have been transferred to the sheet material P to be fixed to the sheet material P.

The sheet material P that has been discharged from the fixing device 40 is processed by the post-processing unit 60 while the sheet material P is transported towards a discharge medium receiving section, which is situated outside of the image forming apparatus 10, by the medium discharging section 54. The sheet material P that has been heated by the fixing device 40 is, first, cooled by the medium cooling section 62. Next, the sheet material P is straightened by the straightening device 64. Then, the image inspecting section 66 detects whether or not an improper toner density, an image defect, or an erroneous image position has occurred, or how improper the toner density is, how defective the image is, or how erroneous the image position is. Then, the sheet material P is discharged to the outside of the second housing 14 by the medium discharging section 54.

When images are to be formed on a non-image surface (back surface) of the sheet material P where images are not formed (that is, when two-side printing is to be performed), the controller 68 switches a transport path of the sheet material P that has passed the image inspecting section 66 to the medium returning section 58 from the medium discharging section 54. This causes the front and back of the sheet material P to be reversed, and the sheet material P to be sent to the medium supplying section 52. By a process that is the same as the above-described process, images are formed on (fixed to) the back surface of the sheet material P, and the sheet material P is discharged to the outside of the second housing 14 by the medium discharging section 54.

Structure of Principal Portion

Next, the sheet feeding devices 70, etc. are described. As shown in FIG. 15, two sheet feeding devices 70 are disposed side by side in the up-down direction of the image forming apparatus 10. The two sheet feeding devices 70 have the same structure. Therefore, here, only one of the sheet feeding devices 70 is described.

Figure 6:
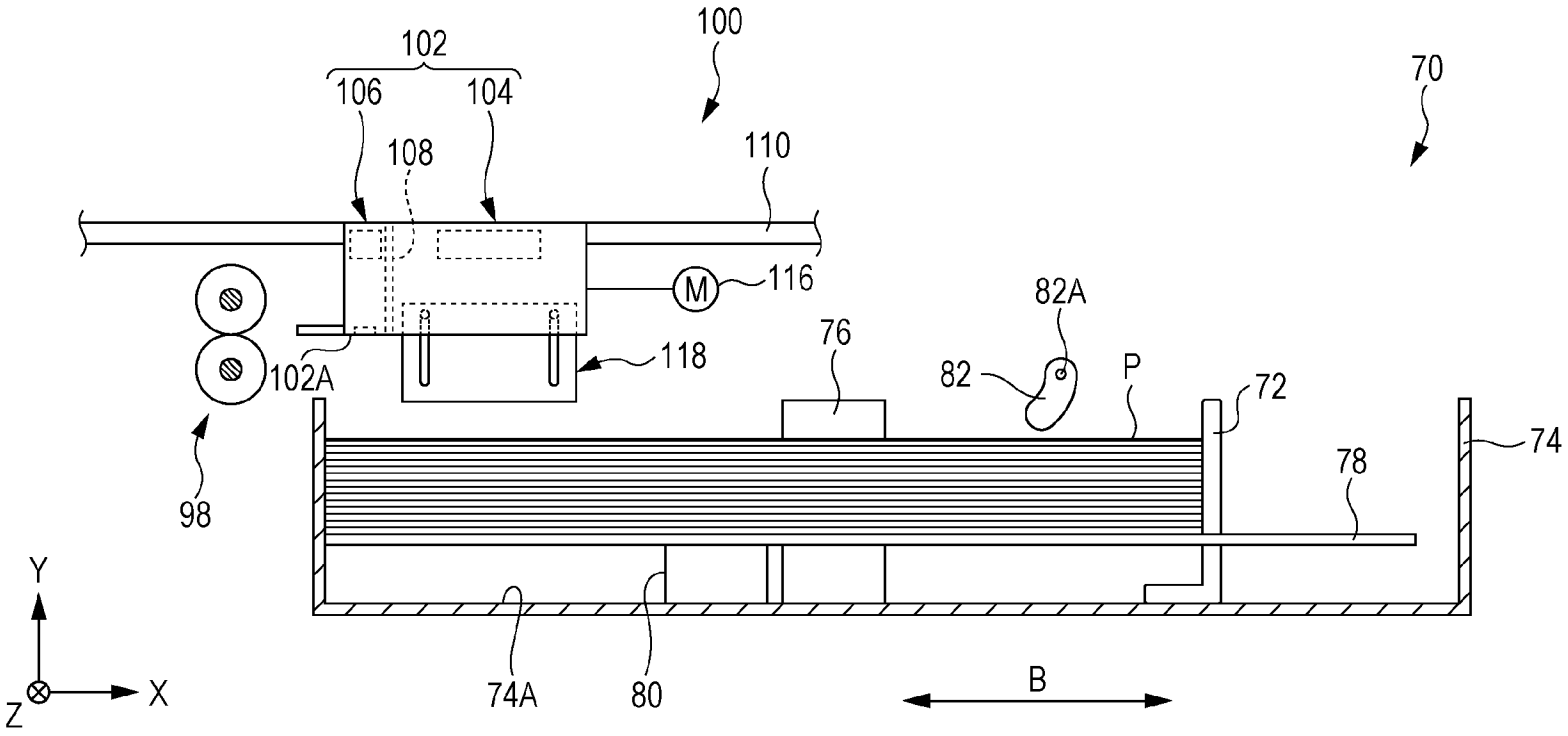
FIG. 6 is a side view of the sheet feeding device according to the first exemplary embodiment of the present invention.

As shown in FIG. 6, the sheet feeding device 70 includes a box member 74 and a bottom plate 78. The box member 74 has an open top. The bottom plate 78 is disposed in the box member 74, and serves as a loading plate on which sheet materials P are loaded. The sheet feeding device 70 also includes an end guide 72 that aligns loading positions in a transport direction of the sheet materials P that are loaded on the bottom plate 78 (that is, the direction of arrow B in FIG. 6, which may hereunder simply be referred to as "sheet-material transport direction") by contacting back edges (right edges in FIG. 6) of the loaded sheet materials P.

The sheet feeding device 70 further includes a pair of side guides 76 that align loading positions in a width direction of the sheet materials P that are loaded on the bottom plate 78 (that is, a depth direction in FIG. 6, which may hereunder simply be referred to as "sheet-material width direction") by contacting both edges of each of the loaded sheet materials P.

The sheet feeding device 70 still further includes a raising and lowering member 80 that is disposed between a bottom plate 74A of the box member 74 and the bottom plate 78 and that raises and lowers the bottom plate 78.

The box member 74 is capable of being drawn out from the first housing 12 towards a near side in the depth direction of the sheet feeding device 70. With the box member 74 being drawn out from the first housing 12, the bottom plate 78 is lowered by the raising and lowering member 80 so as allow a user to load sheet materials P on the bottom plate 78.

Figure 7:
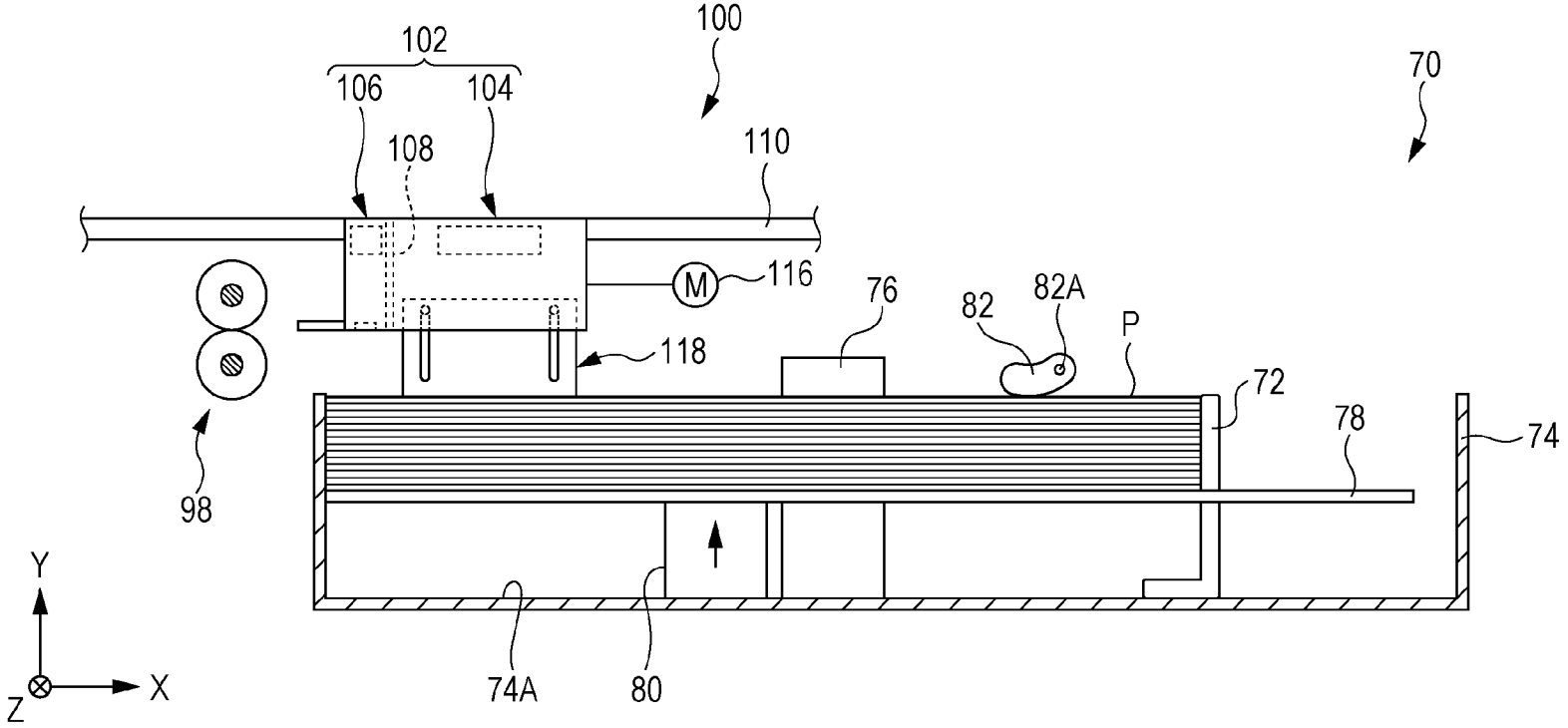
FIG. 7 is a side view of the sheet feeding device according to the first exemplary embodiment of the present invention.

With the box member 74 being mounted in the first housing 12, the bottom plate 78 is raised by the raising and lowering member 80 such that a topmost sheet material P loaded at the bottom plate 78 contacts a skirt 118 of a body member 102 of an attracting mechanism 100 (described below). Refer to FIG. 7.

An arc-shaped detecting member 82 that is rotatably supported by a shaft 82A that is formed at one end of the detecting member 82 is disposed above the box member 74 mounted in the first housing 12. As shown in FIGS. 6 and 7, when the box member 74 is mounted in the first housing 12 and the bottom plate 78 is raised by the raising and lowering mechanism 80, the topmost sheet material P loaded at the bottom plate 78 contacts the detecting member 82. When the detecting member 82 rotates, the contact between the topmost sheet material P and the skirt 118 of the body member 102 is detected so as to stop the bottom plate 78.

Attracting Mechanism 100

The attracting mechanism 100 includes the box-shaped body member 102 including a lifting section 104 and a maintaining section 106. The lifting section 104 attracts a portion of the topmost sheet material P loaded at the bottom plate 78 and lifts the sheet material P. The maintaining section 106 attracts an edge of the sheet material P lifted by the lifting section 104 and maintains the orientation of the edge of the sheet material P.

Figure 11:
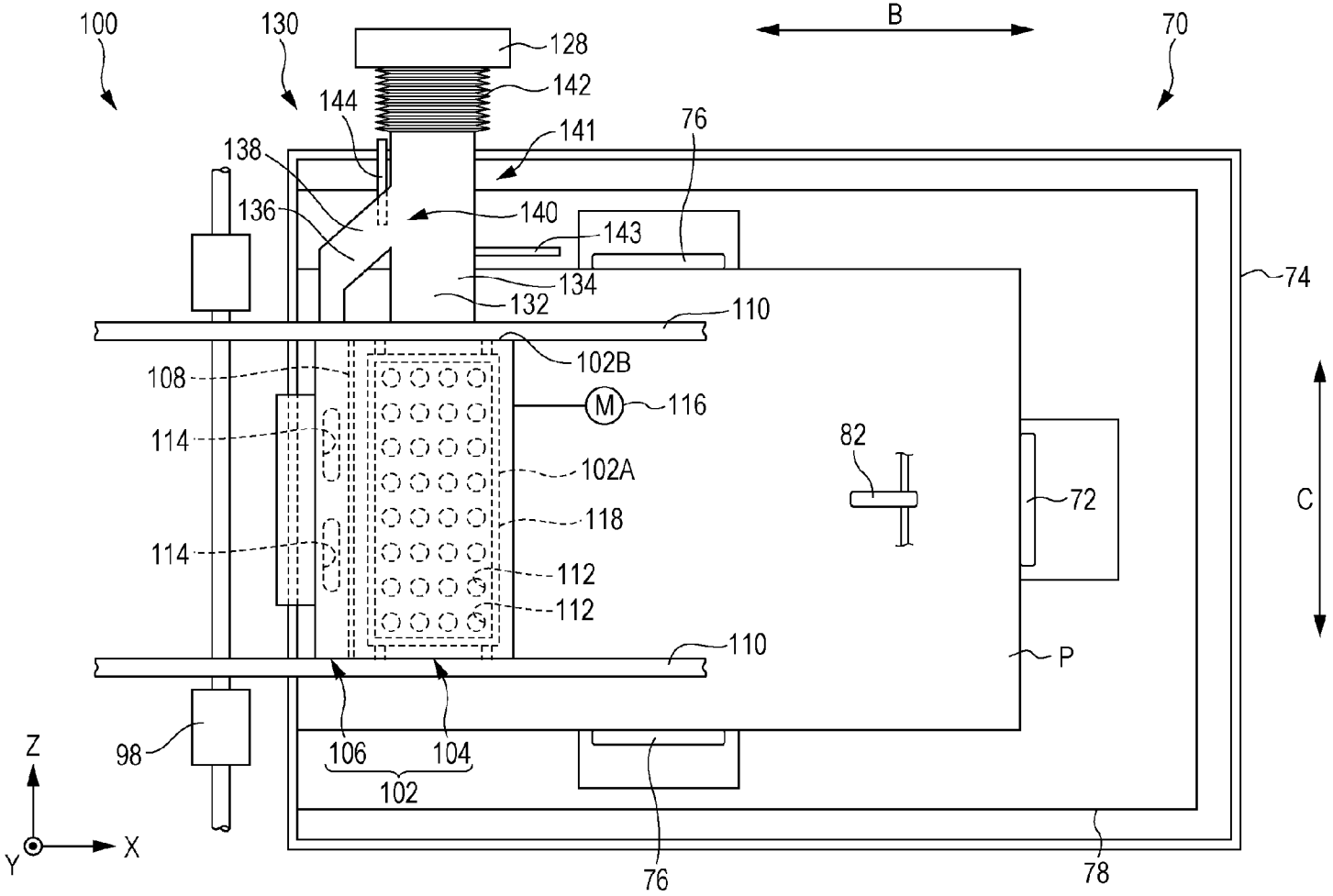
FIG. 11 is a plan view of the sheet feeding device according to the first exemplary embodiment of the present invention.

As shown in FIG. 11, the attracting mechanism 100 further includes a suction fan 128 serving as an exemplary suction member that sucks air in the lifting section 104 and air in the maintaining section 106 and causes attraction forces to be generated at the lifting section 104 and the maintaining section 106. The attracting mechanism 100 includes an air duct 130 serving as an exemplary path member through which the air that has been sucked by the suction fan 128 passes.

Both sides of the body member 102 in the sheet-material width direction (that is, the direction of arrow C in FIG. 11) are supported by a pair of rail members 110 extending in the sheet-material transport direction. The body member 102 is movable along the rail members 110 between an initial position (refer to FIGS. 6 and 11) and a transfer position where the sheet material P lifted by the body member 102 is transferred to transport rollers 98 that transport the sheet material P (refer to FIGS. 9 and 12). As shown in FIG. 6, the body member 102 that has moved to the initial position is disposed at an upper side and at a downstream side in the sheet-material transport direction of the sheet materials P loaded on the bottom plate 78. In this state, the maintaining section 106 opposes edges of the sheet materials P.

Further, a driving motor 116 that moves the body member 102 from the initial position to the transfer position or from the transfer position to the initial position is provided.

Body Member 102

As mentioned above, the body member 102 has the shape of a box and has six sides. As shown in FIGS. 6 and 11, a portion of a bottom plate 102A of the body member 102 protrudes towards the downstream side in the sheet-material transport direction.

An upstream side of the body member 102 in the sheet-material transport direction is defined as the lifting section 104, and a downstream side with respect to the lifting section 104 in the sheet-material transport direction is defined as the maintaining section 106. The lifting section 104 is larger than the maintaining section 106. A partition plate 108 that blocks air flow is formed between the lifting section 104 and the maintaining section 106.

Circular holes 112 that extend through the front and the back of a portion of the bottom plate 102A that forms the lifting section 104 are formed side by side horizontally and vertically in this portion of the bottom plate 102A. In contrast, two long holes 114 that extend through the front and the back of a portion of the bottom plate 102A that forms the maintaining section 106 and that extend in the sheet-material width direction are formed side by side in this portion of the bottom plate 102A in the sheet-material width direction.

Figure 13A:
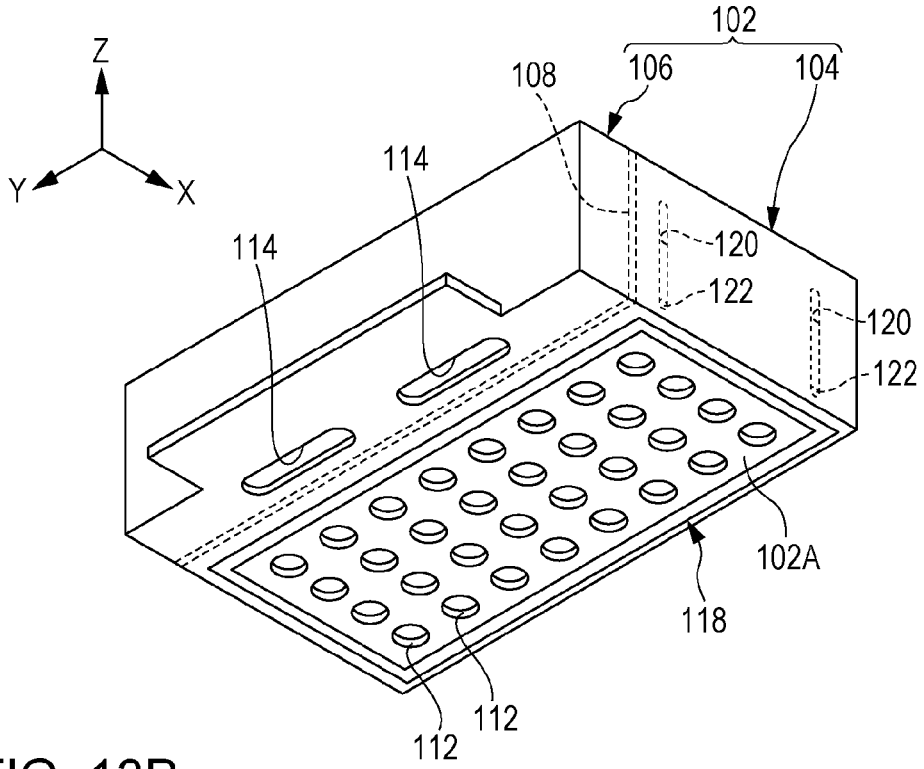
FIGS. 13A and 13B are each a perspective view of a body member of the attracting mechanism that is used in the sheet feeding device according to the first exemplary embodiment of the present invention.
Figure 13B:
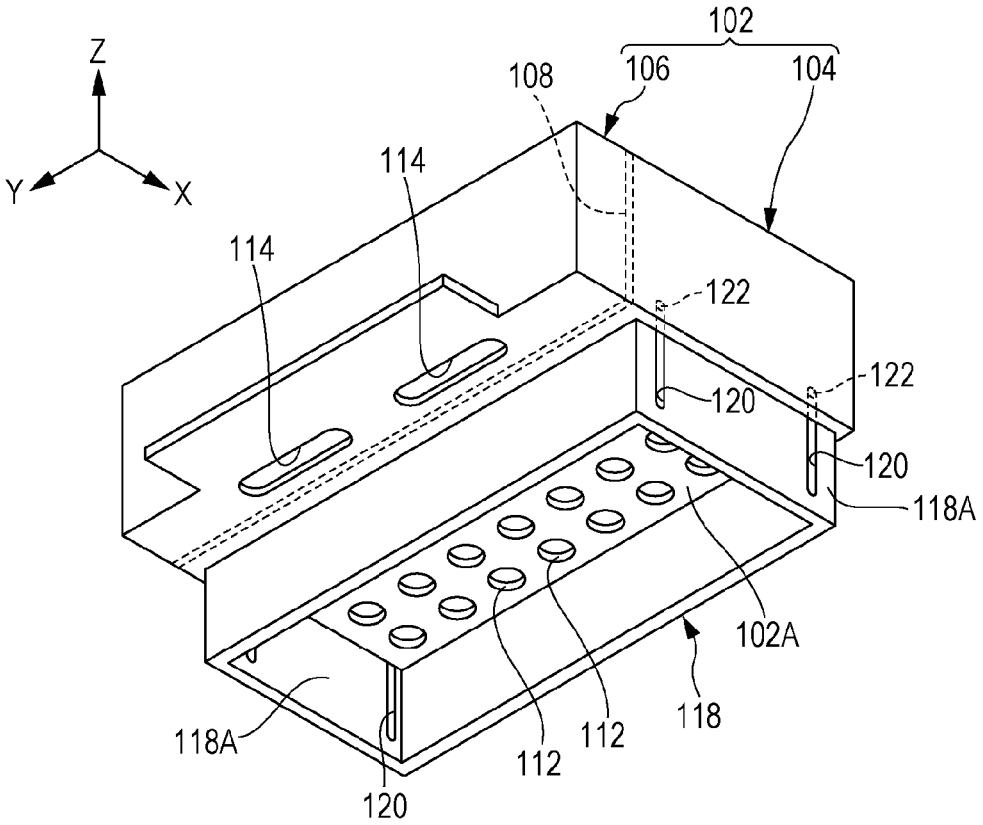

Further, as shown in FIGS. 11, 13A, and 13B, as seen from an upper side, the rectangular cylindrical skirt 118 is provided at the lifting section 104 so as to surround a range in which the circular holes 112 are formed. The skirt 118 is movable between an accommodation position (refer to FIG. 13A), where the skirt 118 is accommodated in the lifting section 104, and a protruding position (refer to FIG. 13B), where the skirt 118 protrudes downward from the bottom plate 102A with a portion thereof remaining in the lifting section 104 as a result of a downward movement of the skirt 118 from the accommodation position.

Two vertically extending long holes 120 are formed in each of two side plates 118 that form the skirt 118 and that oppose each other in the sheet-material width direction. Pins 122 that are inserted in the respective long holes 120 are provided in the lifting section 104. By guiding the pins 122 in the respective long holes 120, the skirt 118 moves between the accommodation position and the protruding position.

If an external force does not act upon the skirt 118, the skirt 118 moves to the protruding position by gravity that is generated at the skirt 118.

Air Duct 130

As shown in FIG. 11, the air duct 130 is a member through which air that is sucked by the suction fan 128 from the interior of the body member 102 passes.

The air duct 130 includes a first duct 134 and a second duct 138. The first duct 134 includes a first path 132 through which air in the lifting section 104 passes. The second duct 138 includes a second path 136 through which air in the maintaining section 106 passes. The air duct 130 also includes a merging portion 140 and a stretchable bellows section 142. The merging portion 140 is where the air sucked from the interior of the lifting section 140 and the air sucked from the maintaining section 106 meet.

An end of the first duct 134 is connected to a portion of a side plate 102B of the body member 102 that forms the lifting section 104. An end of the second duct 138 is connected to a portion of the side plate 102B that forms the maintaining section 106. The side plate 102B has an opening (not shown) that opens the interior of the lifting section 104 into the first path 132, and another opening (not shown) that opens the interior of the maintaining section 106 into the second path 136.

The other end of the first duct 134 and the other end of the second duct 138 are connected to an end of the merging portion 140. The other end of the merging portion 140 and an end of the bellows section 142 are connected to each other. The other end of the bellows section 142 is connected to the suction fan 128.

Figure 12:
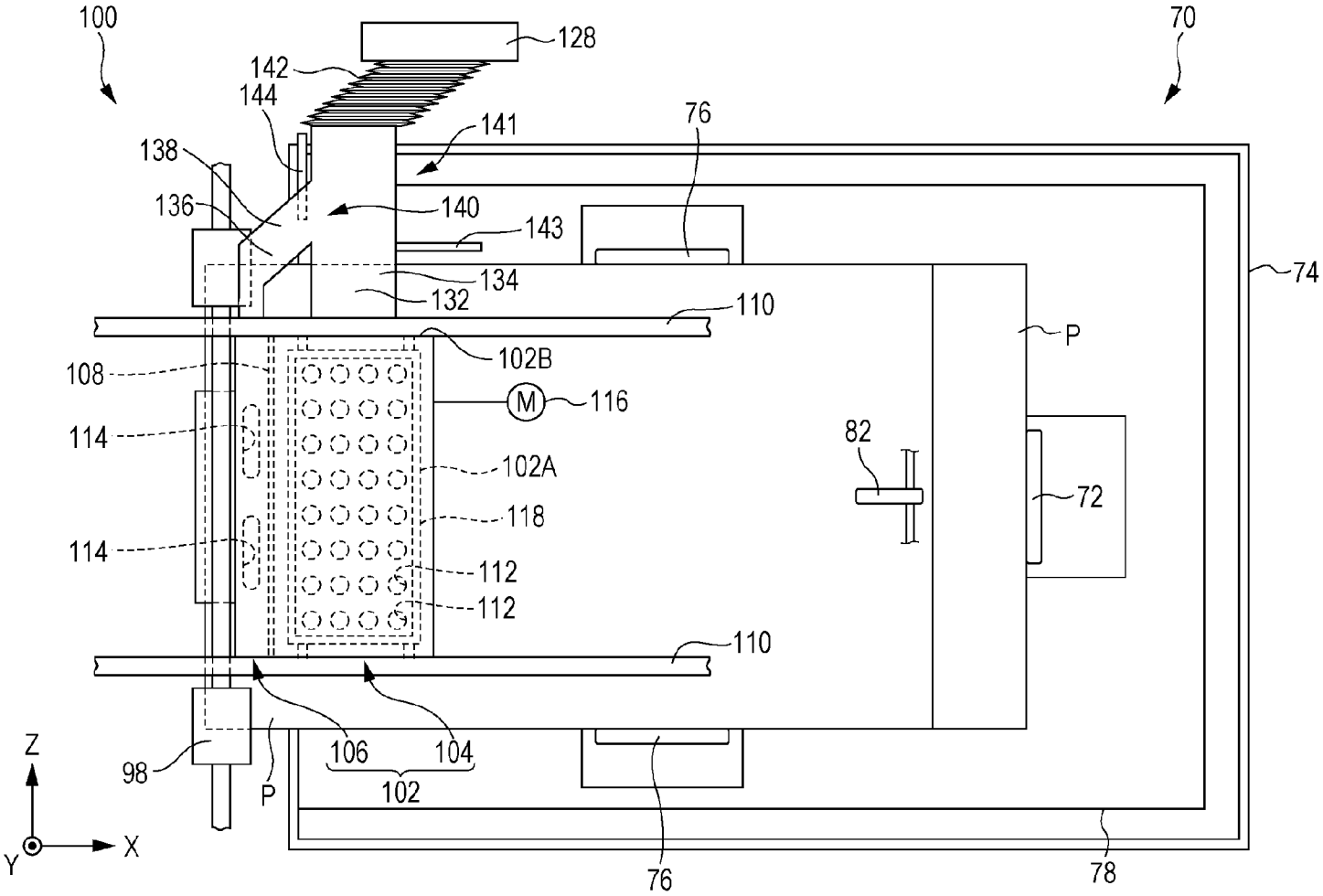
FIG. 12 is a plan view of the sheet feeding device according to the first exemplary embodiment of the present invention.

By virtue of this structure, when the bellows section 142 stretches and contracts while tilting in the sheet-material-P transport direction, the suction fan 128 blows air from the interior of the maintaining section 106 and the interior of the lifting section 104 of the body member 102 that moves between the initial position and the transfer position (refer to FIGS. 11 and 12).

The air is sucked into the lifting section 104 from below the lifting section 104 via the circular holes 112 formed in the bottom plate 102A, and an attraction force that lifts the topmost sheet material P loaded at the bottom plate 78 is generated at the lifting section 104.

The air is sucked into the maintaining section 106 from below the maintaining section 106 via the long holes 114 formed in the bottom plate 102A, and an attraction force that maintains the orientation of an edge of the sheet material P is generated at the maintaining section 106 by attracting the edge of the sheet material P that is lifted by the lifting section 104.

The sheet feeding device 70 includes a changing mechanism 141 that is capable of changing at least one of the attracting force that is generated at the lifting section 104 and the attracting force that is generated at the maintaining section 106.

Changing Mechanism 141

Figure 1:
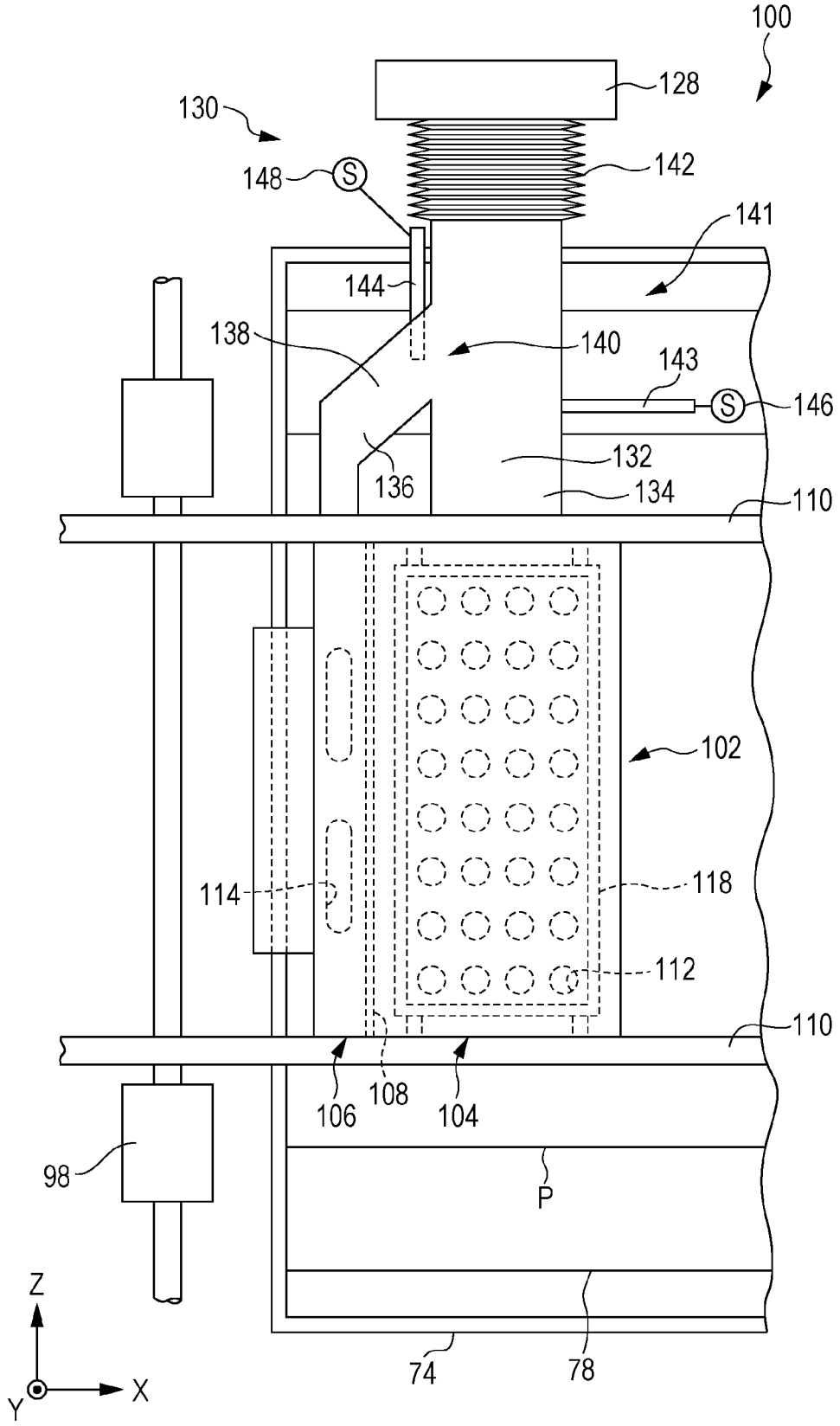
FIG. 1 is a plan view of an attracting mechanism that is used in a sheet feeding device according to a first exemplary embodiment of the present invention.

As shown in FIG. 1, the changing mechanism 141 includes a blocking plate 143 that changes the area of the first path 132 and a blocking plate 144 that changes the area of the second path 136. The changing mechanism 141 also includes a solenoid 146 that moves the blocking plate 143 so as to change the area of the first path 132 and a solenoid 148 that moves the blocking plate 144 so as to change the area of the second path 136.

Figure 2B:
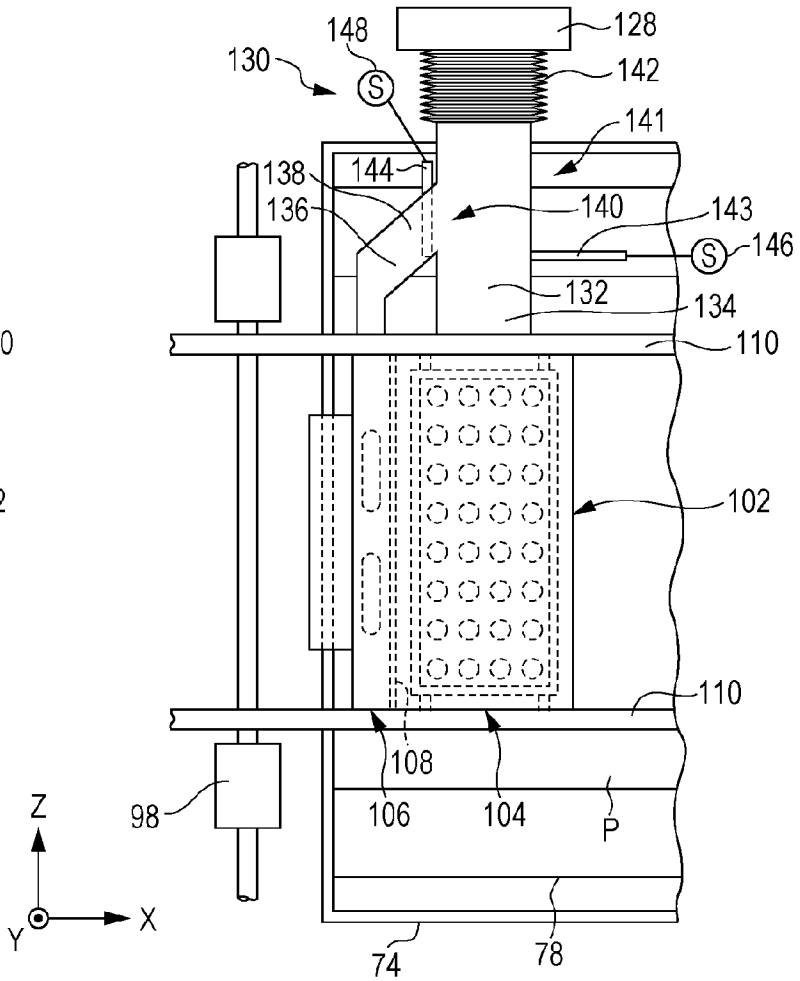
FIGS. 2A and 2B are each a plan view of the attracting mechanism that is used in the sheet feeding device according to the first exemplary embodiment of the present invention.
Figure 2A:
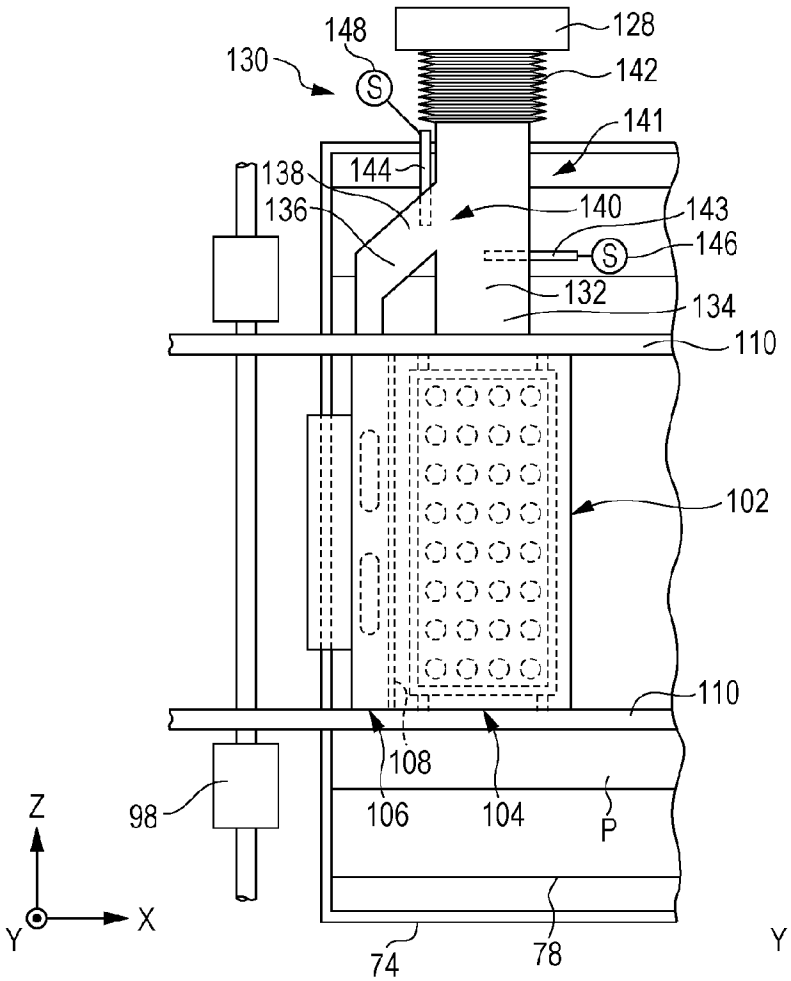

In this structure, with the solenoid 146 being turned off, the area of the first path 132 is not made small (is not blocked), whereas, with the solenoid 146 being turned on, the area of the first path 132 is halved at a portion of the first path 132 (refer to FIG. 2A).

In addition, with the solenoid 148 being turned off, the area of the second path 136 is halved at a portion of the second path 136 (refer to FIG. 1), whereas, with the solenoid 148 being turned on, the second path 136 is closed (refer to FIG. 2B).

Other

As shown in FIG. 15, the image forming apparatus 10 includes a sheet type inputting mechanism 150 and a basis weight inputting mechanism 152. The sheet type inputting mechanism 150 allows a user to input information regarding whether sheet materials P that are fed are ordinary sheets, coated sheets, or envelopes. The basis weight inputting mechanism 152 allows a user to input information regarding the basis weight (JIS P-8124) of the sheet materials P that are fed.

Ordinary sheets are sheet materials P that are generally used in forming images and whose front and back surfaces are not coated. Ordinary sheets include recycled sheets. Coated sheets are sheet materials P whose surfaces are coated with, for example, paint or synthetic resin. Coated sheets include label sheets (sheet materials P whose back surface is provided with an adhesive layer).

The controller 68 receives information regarding the size of the sheet materials P (hereunder referred to as "sheet size") on the basis of the positions of the side guides 76 and the end guide 72 that align the sheet materials P loaded on the bottom plate 78.

Figure 4:
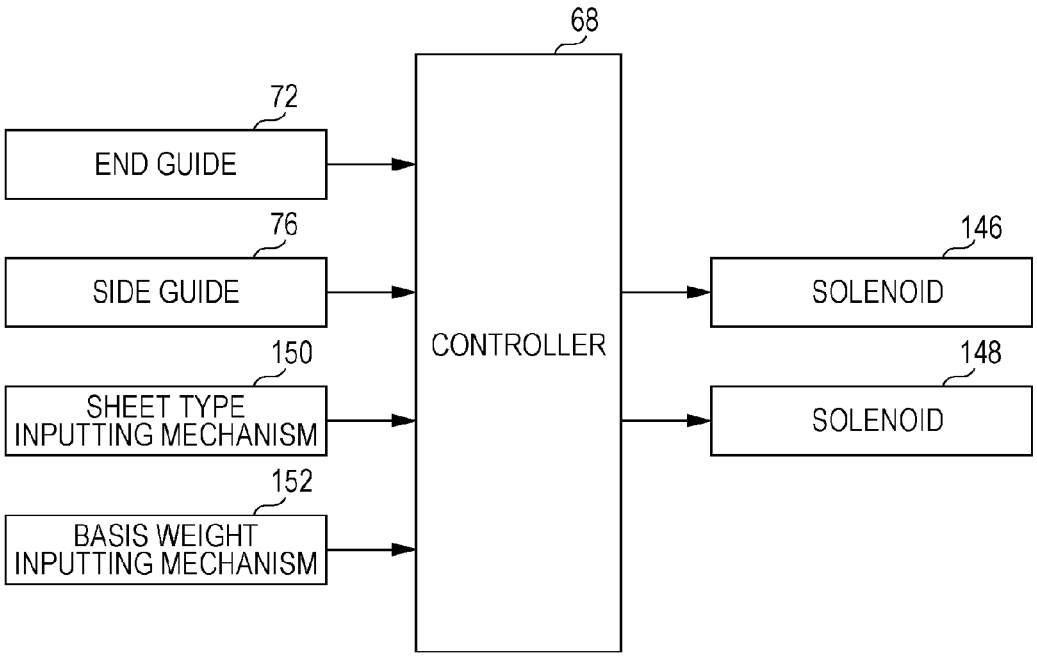
FIG. 4 is a block diagram of some of control forms of a controller provided at an image forming apparatus according to the first exemplary embodiment of the present invention.

As shown in FIG. 4, the controller 68 turns on or off the solenoids 146 and 148 on the basis of the information regarding the sheet size based on the position of the end guide 72 and the positions of the side guides 76, the information regarding the sheet type provided by the sheet type inputting mechanism 150, and the information regarding the basis weight provided by the basis weight inputting mechanism 152.

If a user does not input the sheet type into the sheet type inputting mechanism 150, the controller 68 determines that the sheet materials P that are fed are ordinary sheets. If the user does not input the basis weight into the basis weight inputting mechanism 152, the controller 68 determines that the basis weight of the sheet materials P that are fed is, for example, 110 g/$m^2$.

FIG. 5 is a table of classes 1 to 3 of sheet materials P that are fed based on information regarding the sheet size, information regarding the sheet type, and information regarding the basis weight. The controller 68 controls the solenoids 146 and 148 on the basis of which class the sheet materials P belong. The control operation is described along with operations described below.

Operations of Principal Structure

Next, the operations of the principal structure are described with reference to, for example, the flowchart shown in FIG. 3.

First, as shown in FIGS. 7 and 11, with a switch of the image forming apparatus 10 being turned on, the body member 102 is moved to (is disposed at) the initial position. The skirt 118 is moved to (is disposed at) the protruding position. A topmost sheet material P loaded at the bottom plate 78 is in contact with the skirt 118. The solenoids 146 and 148 are turned off (refer to FIG. 1).

A user inputs information regarding the sheet type of sheet materials P into the sheet type inputting mechanism 150, and information regarding the basis weight of the sheet materials P into the basis weight inputting mechanism 152.

Figure 3:
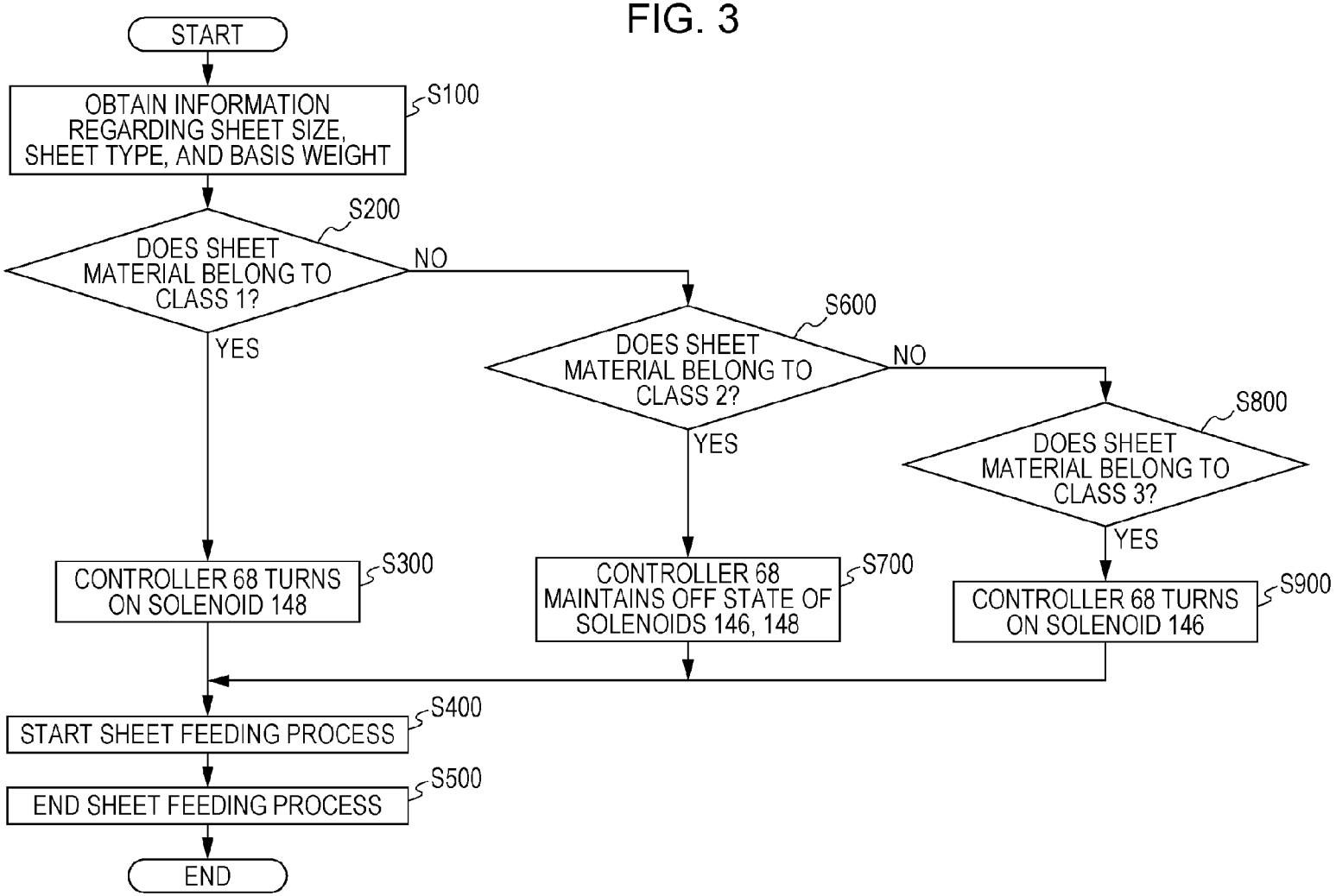
FIG. 3 is a flowchart of steps of controlling the sheet feeding device according to the first exemplary embodiment of the present invention.

If the user inputs an instruction for executing a job, in Step S100 shown in FIG. 3, the controller 68 obtains information regarding the sheet size based on the position of the end guide 72 and the positions of the side guides, the information regarding the sheet type provided by the sheet type inputting mechanism 150, and the information regarding the basis weight provided by the basis weight inputting mechanism 152. When the controller 68 has obtained these pieces of information, the process proceeds to Step S200.

In Step S200, the controller 68 determines whether or not the sheet materials P belong to class 1 in the table shown in FIG. 5. The sheet materials P that belong to class 1 are ordinary sheets or coated sheets and are thick sheets whose basis weight is larger than the basis weight of sheet materials P generally used in forming images. In other words, the sheet materials P that belong to class 1 are ordinary sheets or coated sheets and are thick sheets whose mass is larger than the mass of sheet materials P generally used in forming images.

If the sheet materials P belong to class 1, the process proceeds to Step S300, whereas, if the sheet materials P do not belong to class 1, the process proceeds to Step S600.

In Step S300, when the controller 68 turns on the solenoid 148, as shown in FIG. 2B, the second path 136 is closed by the blocking plate 144. When the second path 136 is closed, the process proceeds to Step S400 and a sheet feeding process is started. The sheet feeding process is hereunder described.

In the sheet feeding process, first, the suction fan 128 is operated, and air is sucked into the lifting section 104 from below the lifting section 104 via the circular holes 112 formed in the bottom plate 102A. This causes the pressure in a space surrounded by the skirt 118 to become a negative pressure, so that an attraction force that lifts a sheet material P loaded at the bottom plate 78 is generated.

Figure 8:
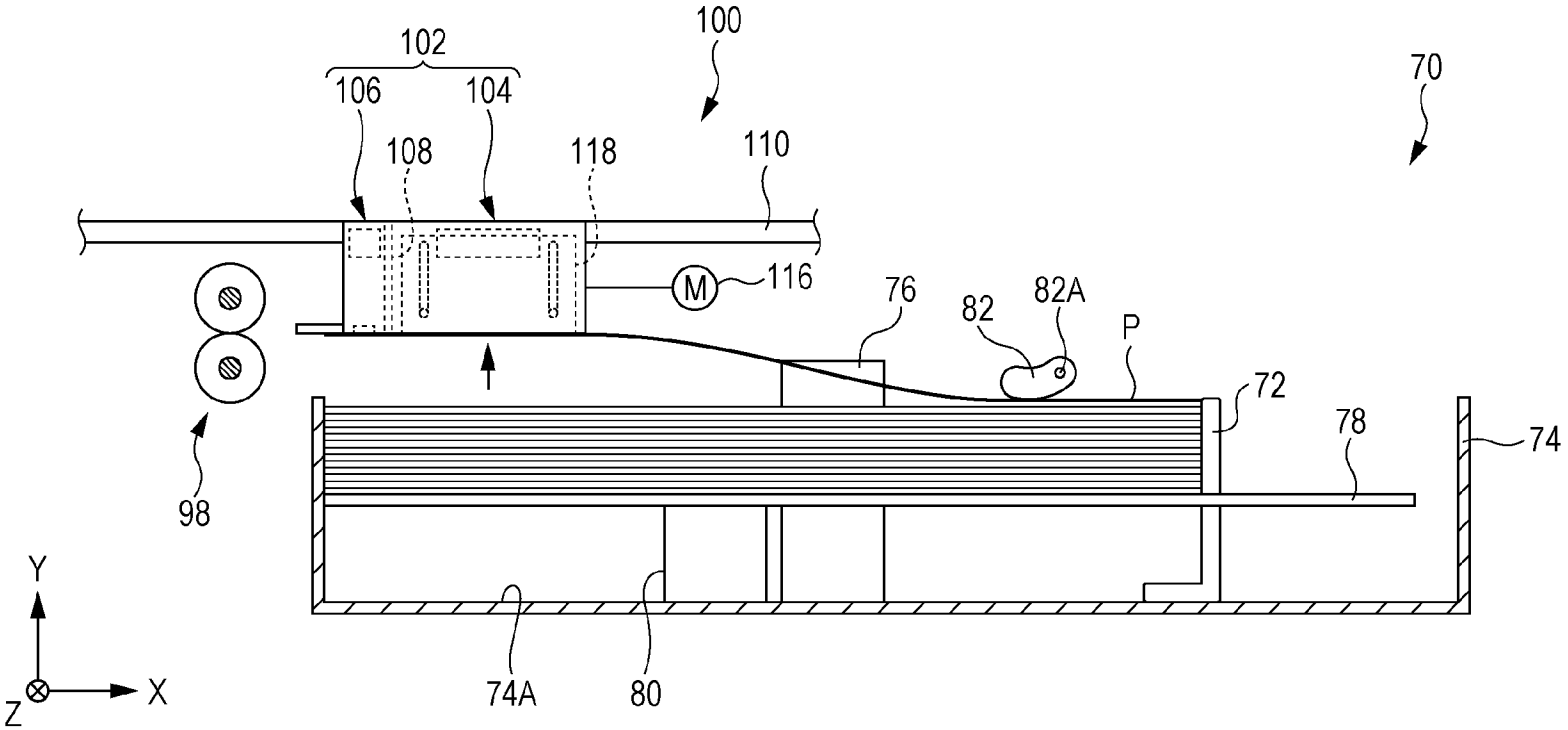
FIG. 8 is a side view of the sheet feeding device according to the first exemplary embodiment of the present invention.

As shown in FIGS. 7 and 8, the attraction force lifts a topmost sheet material P loaded at the bottom plate 78, and the skirt 118 moves from the protruding position to the accommodation position. Then, the portion of the sheet material P that has been lifted by the lifting section 104 contacts the portion of the bottom plate 102A that forms the lifting section 104.

Figure 9:
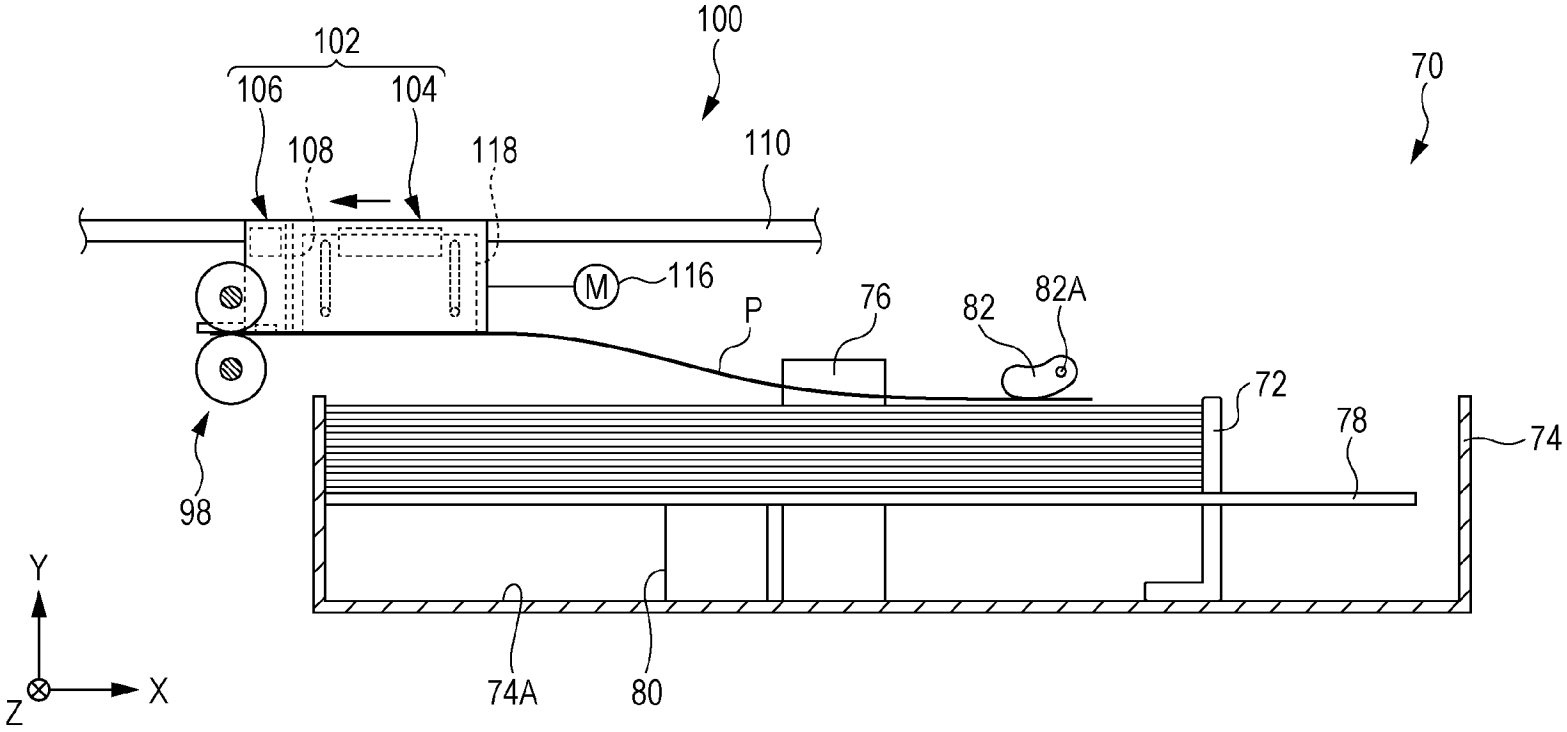
FIG. 9 is a side view of the sheet feeding device according to the first exemplary embodiment of the present invention.

In this state, when the transport rollers 98 rotate, the driving motor 116 operates. By operating the driving motor 116, as shown in FIGS. 8 and 9, the body member 102 that has lifted the sheet material P is moved from the initial position to the transfer position.

Figure 10:
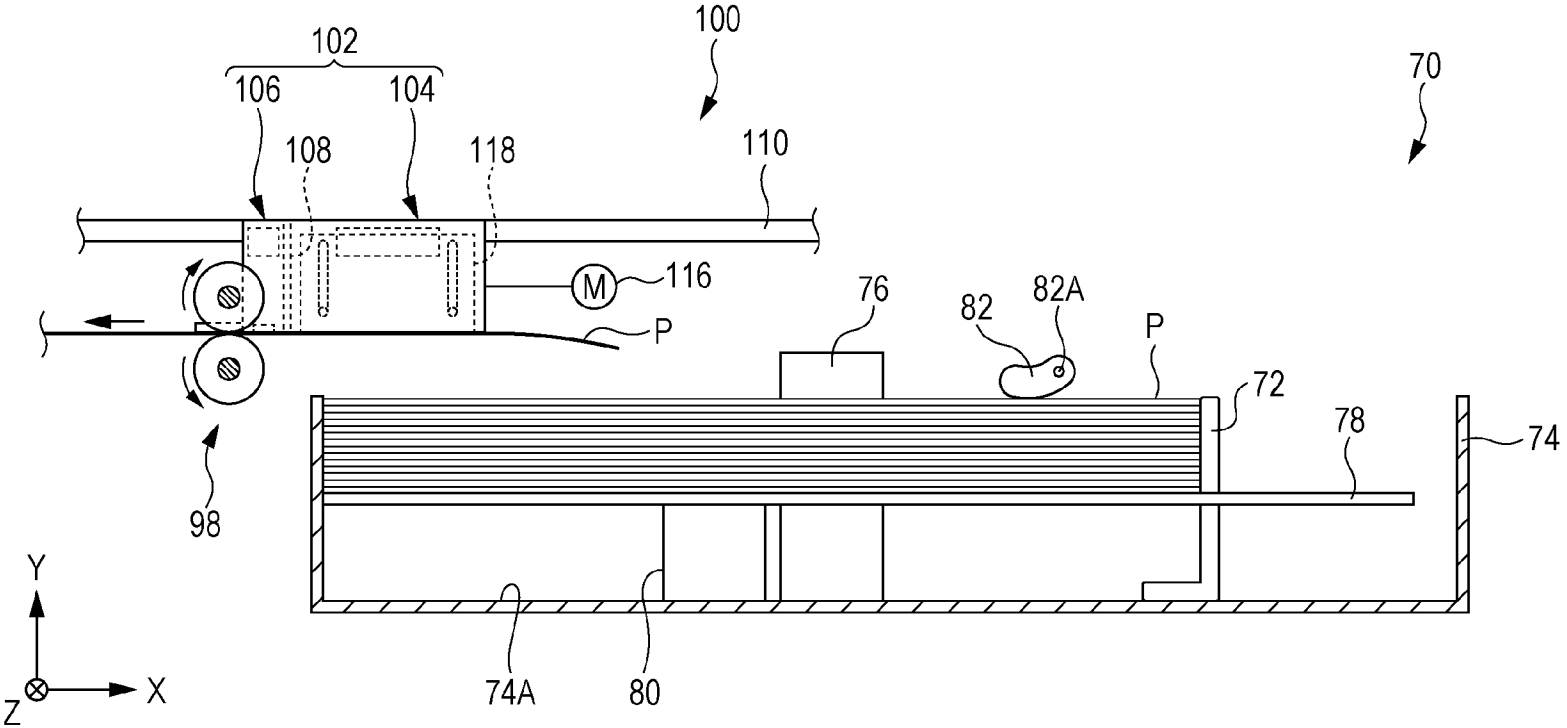
FIG. 10 is a side view of the sheet feeding device according to the first exemplary embodiment of the present invention.

When the body member 102 moves to the transfer position, the suction fan 128 stops and, as shown in FIG. 10, the sheet material P that has been lifted by the body member 102 is transferred to the transport rollers 98 that are rotating, and is transported downstream in the sheet-material transport direction.

When the sheet material P is transported by the transport rollers 98, the driving motor 116 is operated, and the body member 102 moves from the transfer position to the initial position. When images are to be formed on sheet materials P by one job, the aforementioned process is repeated.

When all of the sheet materials P have been fed, the body member 102 moves to the initial position, and the process proceeds to Step S500 to end the sheet feeding process (that is, to end the job).

In this way, if the sheet materials P belong to class 1 (that is, if the sheet materials P are thick sheets), the second path 136 is closed by the blocking plate 144. Therefore, the attraction force that is generated at the lifting section 104 is stronger than that when the second path 136 is not closed. In this way, since the attraction force that is generated at the lifting section 104 becomes stronger, the lifting section 104 may effectively lift the sheet material P, which is a thick sheet, than when the attraction force does not become stronger.

By closing the second path 136 with the blocking plate 144, an attraction force is not generated at the maintaining section 106. However, since the sheet materials P are thick sheets, the orientation of an edge of a sheet material P is maintained (that is, an edge of a sheet material P does not hang down).

In contrast, if, in Step S200, the sheet materials P do not belong to class 1, and the process proceeds to Step S600, the controller 68 determines whether or not the sheet materials P belong to class 2 in the table shown in FIG. 5. The sheet materials P that belong to class 2 are ordinary sheets or coated sheets, have a basis weight that is smaller than that of sheet materials P that belong to class 1, and are generally used in forming images. If the sheet materials P belong to class 2, the process proceeds to Step S700, whereas, if they do not belong to class 2, the process proceeds to Step S800.

In Step S700, when the controller 68 maintains the off states of the solenoids 146 and 148, as shown in FIG. 1, the area of the first path 132 is not made smaller, and the area of the second path 136 is halved at a portion of the second path 136. In this state, the process proceeds to Step S400 and the aforementioned sheet feeding process is started. Then, the sheet feeding process ends in Step S500.

Accordingly, if the sheet materials P belong to class 2 (that is, when the sheet materials P are sheet materials P that are generally used in forming images), the area of the first path 132 is not made smaller and the area of the second path 136 remains halved at a portion of the second path 136. Therefore, attraction force that is generated at the maintaining section 106 becomes stronger in this case than when the second path 136 is closed. Accordingly, since the attraction force that is generated at the maintaining section 106 becomes stronger, the maintaining section 106 may effectively maintain the orientation of an edge of a sheet material P than when the attraction force at the maintaining section 106 does not become stronger.

By halving the area of the second path 136 at a portion of the second path 136, attraction force at the lifting section 104 becomes weaker. However, since the basis weight of the sheet materials P that belong to class 2 is smaller than that of sheet materials P that belong to class 1 (that is, since the mass of the sheet materials P that belong to class 2 is smaller than that of sheet materials P that belong to class 1), a weak attraction force at the lifting section 14 is not an obstacle to lifting a sheet material P by the lifting section 104.

In contrast, if, in Step S600, the sheet materials P do not belong to class 2, and the process proceeds to Step S800, the controller 68 determines whether or not the sheet materials P belong to class 3 in the table shown in FIG. 5. The sheet materials P that belong to class 3 are coated sheets and are thin sheets whose basis weight (thickness) is smaller than that of sheet materials P that belong to class 2 and the basis weight (thickness) of sheet materials P that are generally used in forming images. The sheet materials P that belong to class 3 are envelopes. If, in Step S800, the controller 68 determines that the sheet materials P belong to class 3, the process proceeds to Step S900.

In Step S900, when the controller 68 turns on the solenoid 146, as shown in FIG. 2A, the area of the first path 132 is halved at a portion of the first path 132. In this state, the process proceeds to Step S400 and the aforementioned sheet feeding process is started. Then, in Step S500, the sheet feeding process ends.

Accordingly, if the sheet materials P belong to class 3 (that is, if the sheet materials P are thin sheets), the area of the first path 132 is halved at a portion of the first path 132, and the area of the second path 136 is halved at a portion of the second path 136. Therefore, attraction force that is generated at the maintaining section 106 becomes stronger than that when the area of the first path 132 is not made smaller. Accordingly, since the attraction force that is generated at the maintaining section 106 becomes stronger, the maintaining section 106 may effectively maintain the orientation of an edge of a sheet material P, which is a thin sheet, compared to when the attraction force at the maintaining section 106 does not become stronger.

By halving the area of the second path 136 at a portion of the second path 136, attraction force at the lifting section 104 becomes weaker than that when sheet materials P belong to class 2. However, since the basis weight (mass) of the sheet materials P that belong to class 3 is smaller than the basis weight (mass) of sheet materials P that belong to class 2, a weak attraction force at the lifting section 104 is not an obstacle to lifting a sheet material P by the lifting section 104.

Sheet materials P which are envelopes (such as standard-size envelopes of 120 mm by 235 mm) are evaluated by an actual device. As a result of the evaluation, it is confirmed that, under conditions that are the same as those for thin sheets, a sheet material P may be effectively lifted by the lifting section 104 and the orientation of an edge of the sheet material P may be effectively maintained by the maintaining section 106 than under other conditions.

Summary of Principal Structure

As described above, by using the changing mechanism 141, at least one of the attraction force that is generated at the lifting section 104 and the attraction force that is generated at the maintaining section 106 is changed. In other words, when a portion of a sheet material P is attracted and the sheet material P is fed, the attraction force is partly increased or decreased within a range in which the sheet material P is attracted.

By changing at least one of the attraction force that is generated at the lifting section 104 and the attraction force that is generated at the maintaining section 106 in accordance with the sheet type or the basis weight, a proper attraction force that is in accordance with the sheet type or the basis weight is generated at at least one of the lifting section 104 and the maintaining section 106.

By causing a proper attraction force to be generated at at least one of the lifting section 104 and the maintaining section 106, sheet materials P may be effectively fed by the sheet feeding devices 70 (that is, improper sheet feeding is suppressed) compared to when a proper attraction force is not generated.

By effectively feeding sheet materials P by the sheet feeding devices 70, multiple feeding of the sheet materials P is suppressed, and, compared to when multiple feeding is not suppressed, images may be effectively formed on the individual sheet materials P that are fed.

Second Exemplary Embodiment

A sheet feeding device and an image forming apparatus according to a second exemplary embodiment of the present invention are described with reference to FIGS. 16 to 17B. Portions that correspond to those according to the first exemplary embodiment are given the same reference numerals and are not described. Portions that differ from those according to the first exemplary embodiment are principally described.

Figure 16:
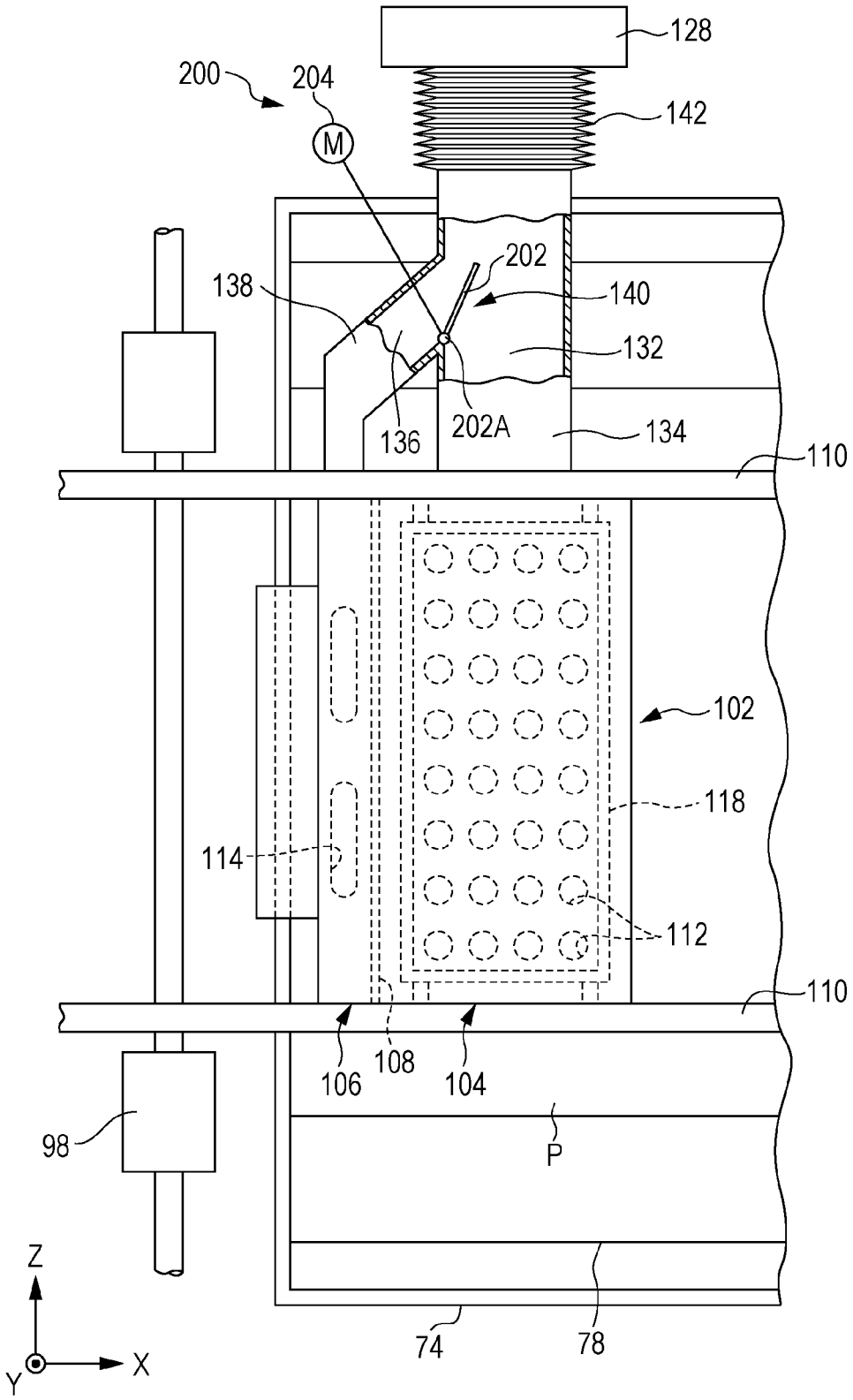
FIG. 16 is a plan view of an attracting mechanism that is used in a sheet feeding device according to a second exemplary embodiment of the present invention.

As shown in FIG. 16, a changing mechanism 200 according to the second exemplary embodiment includes a plate-shaped rotating member 202 which is disposed at a merging portion 140, which rotates around a shaft 202A (disposed at one end of the rotating member 202), and which changes an opening area (path area) of a first path 132 into the merging portion 140 and an opening area (path area) of a second path 136 into the merging portion 140.

The changing mechanism 200 also includes a stepping motor 204 (hereunder simply referred to as "motor 204") that causes the rotating member 202 to rotate.

In a state prior to executing a job, the rotating member 202 is disposed such that the opening area of the first path 132 into the merging portion 140 is larger than the opening area of the second path 136 into the merging portion 140. In this way, the rotating member 202 is disposed at an initial position.

Figure 17B:
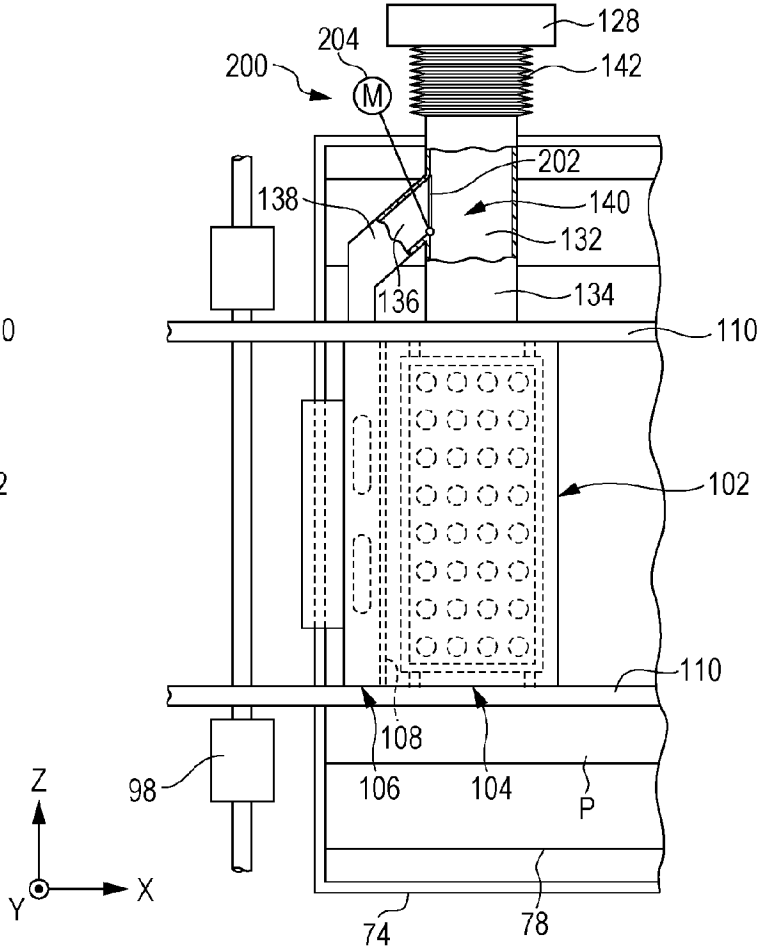
FIGS. 17A and 17B are each a plan view of the attracting mechanism that is used in the sheet feeding device according to the second exemplary embodiment of the present invention.

If a job is to be executed and sheet materials P that are fed belong to class 1, in Step S300, when a controller 68 operates the motor 204, the rotating member 202 rotates and closes the second path 136 as shown in FIG. 17B.

If the sheet materials P that are fed belong to class 2, in Step S700, the controller 68 does not operate the motor 204, and, as shown in FIG. 16, the rotating member 202 is disposed at the initial position.

Figure 17A:
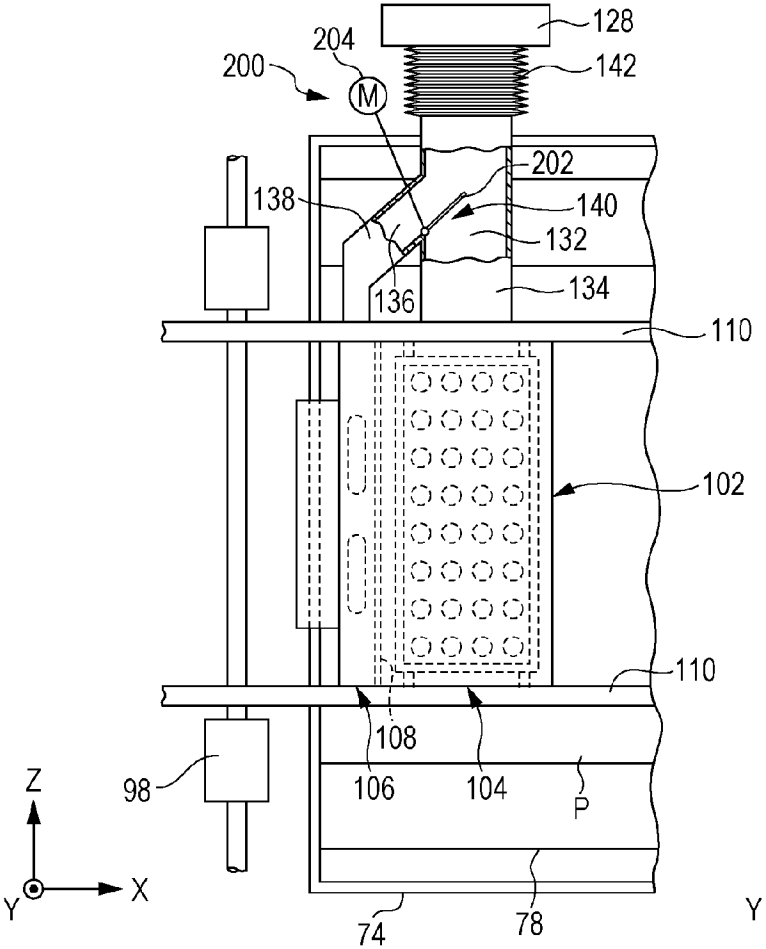

If the sheet materials P that are fed belong to class 3, in Step S900, the controller 68 operates the motor 204, and, as shown in FIG. 17A, the rotating member 202 rotates and is disposed such that the opening area of the first path 132 into the merging portion 140 and the opening area of the second path 136 into the merging portion 140 are the same.

The other operations according to the second exemplary embodiment are the same as those according to the first exemplary embodiment.

Third Exemplary Embodiment

A sheet feeding device and an image forming apparatus according to a third exemplary embodiment of the present invention are described with reference to FIGS. 18 to 19B. Portions that correspond to those according to the first exemplary embodiment are given the same reference numerals and are not described. Portions that differ from those according to the first exemplary embodiment are principally described.

A changing mechanism 220 according to the third exemplary embodiment includes a rotating member 224 which is disposed at a circular merging portion 222, which rotates around a shaft 224A (disposed at the center of the merging portion 222), and which changes an opening area (path area) of a first path 132 into the merging portion 222 and an opening area (path area) of a second path 136 into the merging portion 222.

The rotating member 224 includes an arc-shaped plate 224B and an arc-shaped plate 224C. The arc-shaped plate 224B changes the opening area of the first path 132 into the merging portion 222. The arc-shaped plate 224C changes the opening area of the second path 136 into the merging portion 222.

The changing mechanism 220 also includes a stepping motor 226 (hereunder simply referred to as "motor 226") that causes the rotating member 224 to rotate.

Figure 18:
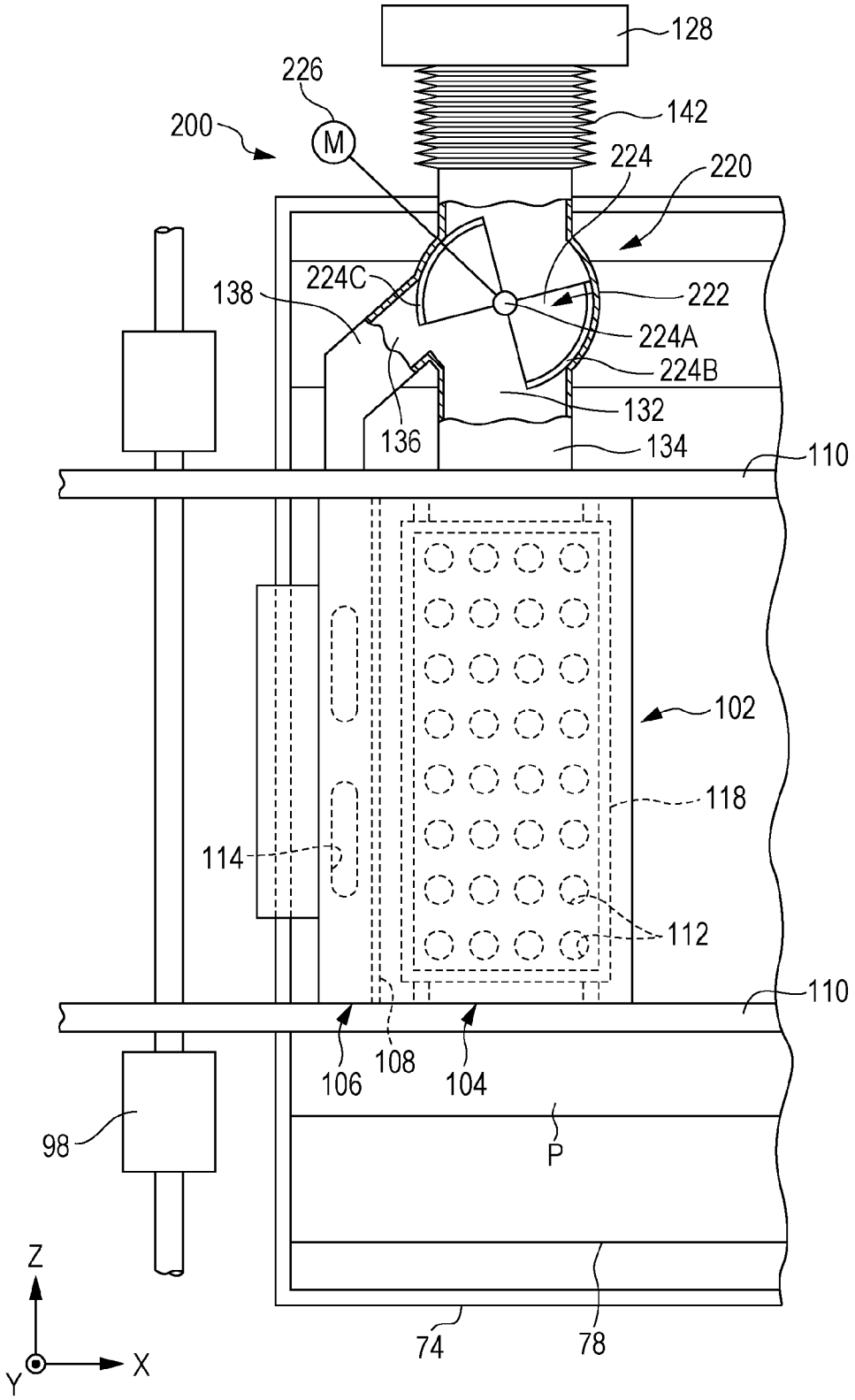
FIG. 18 is a plan view of an attracting mechanism that is used in a sheet feeding device according to a third exemplary embodiment of the present invention.

In a state prior to executing a job, as shown in FIG. 18, the rotating member 224 is disposed such that the opening area of the first path 132 into the merging portion 222 is larger than the opening area of the second path 136 into the merging portion 222. In this way, the rotating member 224 is disposed at an initial position.

Figure 19B:
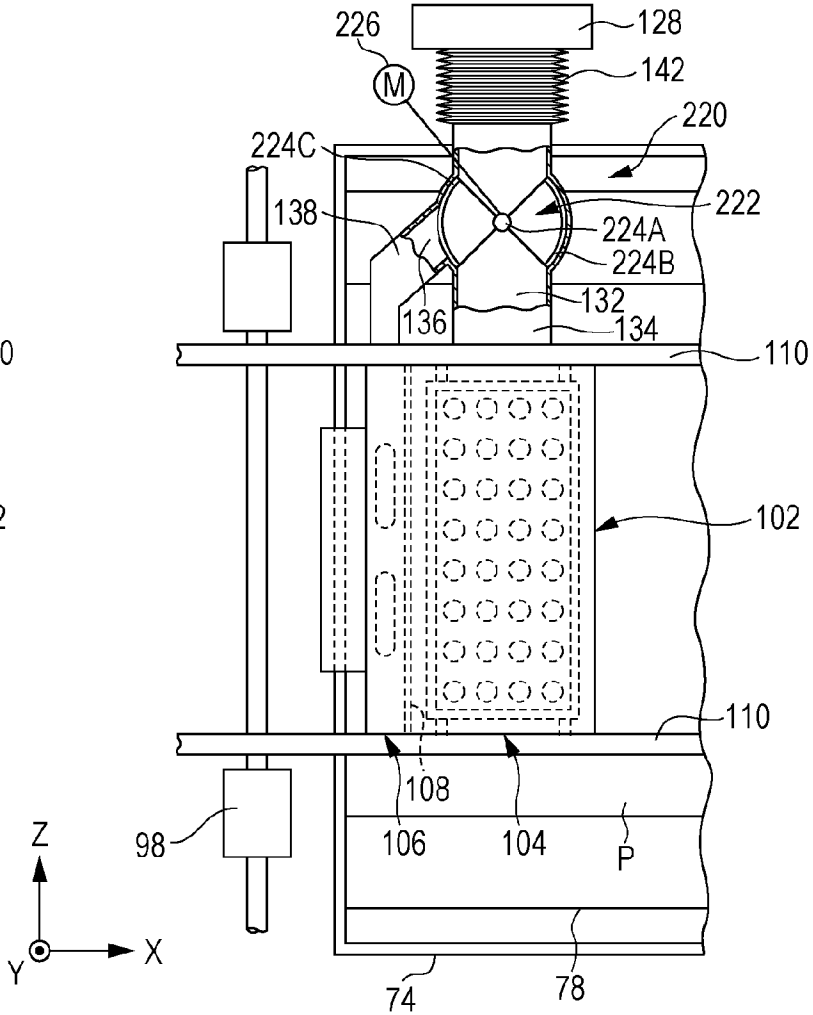
FIGS. 19A and 19B are each a plan view of the attracting mechanism that is used in the sheet feeding device according to the third exemplary embodiment of the present invention.

If a job is to be executed and sheet materials P that are fed belong to class 1, in Step S300, when a controller 68 operates the motor 226, the rotating member 224 rotates and closes the second path 136 as shown in FIG. 19B.

If the sheet materials P that are fed belong to class 2, in Step S700, the controller 68 does not operate the motor 226, and, as shown in FIG. 18, the rotating member 224 is disposed at the initial position.

Figure 19A:
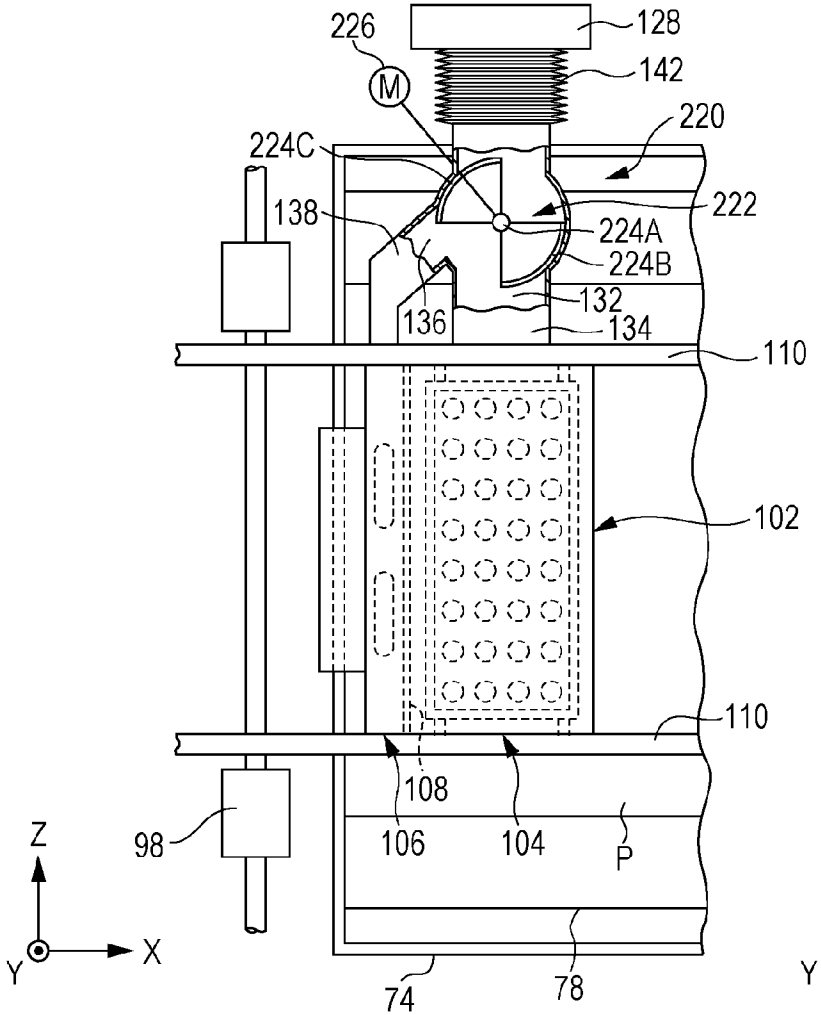

If the sheet materials P that are fed belong to class 3, in Step S900, when the controller 68 operates the motor 226, as shown in FIG. 19A, the rotating member 224 rotates and is disposed such that the opening area of the first path 132 into the merging portion 222 is equal to the opening area of the second path 136 into the merging portion 222.

The other operations according to the third exemplary embodiment are the same as those according to the first exemplary embodiment.

Fourth Exemplary Embodiment

A sheet feeding device and an image forming apparatus 240 according to a fourth exemplary embodiment of the present invention are described with reference to FIG. 20. Portions that correspond to those according to the first exemplary embodiment are given the same reference numerals and are not described. Portions that differ from those according to the first exemplary embodiment are principally described.

Figure 20:
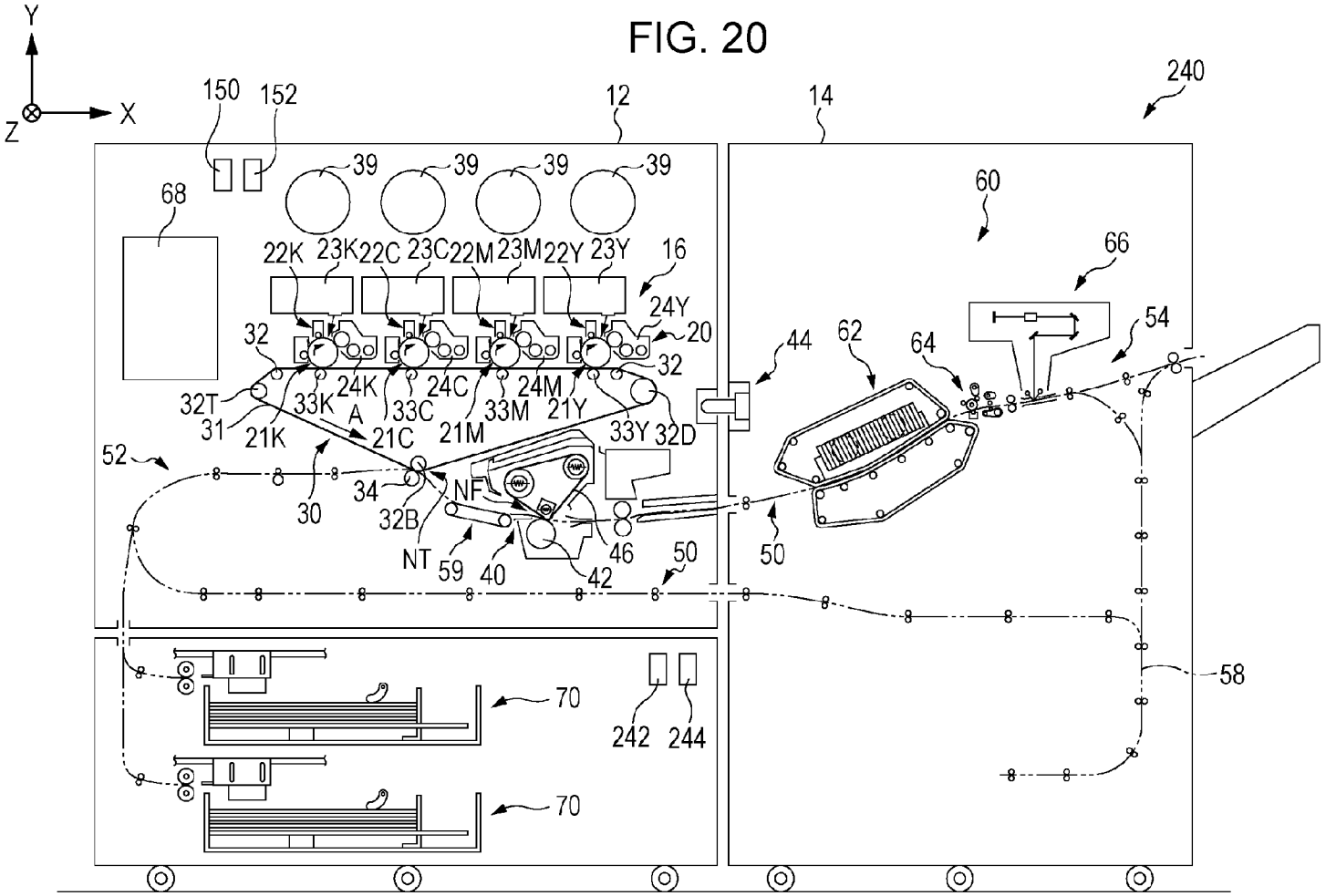
FIG. 20 is a schematic view of a structure of an image forming apparatus according to fourth exemplary embodiment of the present invention.

As shown in FIG. 20, the image forming apparatus 240 includes a humidity detecting unit 242 that detects the humidity in the image forming apparatus 240 and a temperature detecting unit 244 that detects the temperature in the image forming apparatus 240.

If the detection humidity that is detected by the humidity detecting unit 242 is greater than or equal to a predetermined threshold humidity (such as 85% RH), and if the detection temperature that is detected by the temperature detecting unit 244 is greater than or equal to a predetermined threshold temperature (such as 28° C.), the controller 68 causes attraction force that is generated by a lifting section 104 to be stronger than if the detection humidity is less than the threshold humidity or the detection temperature is less than the threshold temperature.

More specifically, using a changing mechanism 141, a controller 68 increases the area of a first path 132 or reduces the area of a second path 136 to make strong the attraction force that is generated at the lifting section 104.

Adhesion between loaded sheet materials P is stronger when the temperature and humidity are high than when the temperature and humidity are low. However, if the temperature and humidity are high, when the controller 68 makes stronger the attraction force that is generated at the lifting section 104 as mentioned above, a sheet material P may be effectively lifted by the lifting section 104 than when the attraction force that is generated at the lifting section 104 does not change. The other operations according to the fourth exemplary embodiment are the same as those according to the first exemplary embodiment.

Although specific exemplary embodiments of the present invention are described in detail, the present invention is not limited to such exemplary embodiments. It is apparent to those skilled in the art that various other exemplary embodiments are possible within the scope of the invention. For example, in the exemplary embodiments, as shown in FIG. 5, the changing mechanisms 141, 200, and 202 perform control for the classes 1 to 3 of sheet materials P that are transported. However, for example, when a user inputs information that the sheet materials P are coated sheets into the sheet type inputting mechanism 150, compared to when the user inputs information that the sheet materials P are ordinary sheets into the sheet type inputting mechanism 150, attraction force that is generated at the maintaining section 106 may be made stronger using the corresponding one of the changing mechanisms 141, 200, and 202. In this case, the orientation of an edge of a coated sheet that tends to hang down compared to an edge of an ordinary sheet may be effectively maintained.

In the above-described exemplary embodiments, as shown in FIG. 5, the changing mechanisms 141, 200, and 202 perform control for the classes 1 to 3 of sheet materials P that are transported. However, for example, when a basis weight is greater than the basis weight that has been input to the basis weight inputting mechanism 152, the corresponding one of the changing mechanisms 141, 200, and 202 may be used to make stronger the attraction force that is generated at the maintaining section 106. In this case, the orientation of an edge of a sheet material P having a small basis weight at which the edge of the sheet material P tends to hang down compared to a sheet material P having a large basis weight may be effectively maintained.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sheet feeding device comprising:

an attracting mechanism that includes a lifting section, a maintaining section, and a suction fan, the lifting section configured to attract a portion of a sheet material that is fed and lifting the portion of the sheet material by a first attraction force generated by the suction fan, the maintaining section configured to attract an edge of the sheet material that is lifted by the lifting section by a second attraction force generated by the suction fan and maintaining an orientation of the edge of the sheet material; and a changing mechanism configured to change at least one of the first attraction force that is generated at the lifting section and the second attraction force that is generated at the maintaining section, wherein the changing mechanism is configured to change the first attraction force independently from the second attraction force.

2. The sheet feeding device according to claim 1, wherein the attracting mechanism further includes a path member, the suction member sucking air in the lifting section and air in the maintaining section and generating the first attraction force at the lifting section and the second attraction force at the maintaining section, the path member including a first air duct and a second air duct, the air in the lifting section that is sucked by the suction member passing through the first air duct, the air in the maintaining section that is sucked by the suction member passing through the second air duct, and wherein, when the at least one of the first attraction force that is generated at the lifting section and the second attraction force that is generated at the maintaining section is changed, at least one of an area of the first air duct and an area of the second air duct is changed by the changing mechanism.

3. An image forming apparatus comprising:

the sheet feeding device according to claim 2; and an image forming unit that forms an image on the sheet material that is fed by the sheet feeding device.

4. The image forming apparatus according to claim 3, further comprising a humidity detecting unit that detects a humidity in the image forming apparatus and a temperature detecting unit that detects a temperature in the image forming apparatus, wherein, if the humidity that is detected by the humidity detecting unit is greater than or equal to a predetermined threshold humidity, and if the temperature that is detected by the temperature detecting unit is greater than or equal to a predetermined threshold temperature, the changing mechanism is used to make stronger the first attraction force that is generated at the lifting section than if the humidity that is detected by the humidity detecting unit is less than the threshold humidity or the temperature that is detected by the temperature detecting unit is less than the threshold temperature.

5. The image forming apparatus according to claim 3, wherein information regarding a basis weight of the sheet material that is fed is obtained, and, if a basis weight is greater than the obtained basis weight, the changing mechanism is used to make stronger the second attraction force that is generated at the maintaining section.

6. The image forming apparatus according to claim 5, further comprising a humidity detecting unit that detects a humidity in the image forming apparatus and a temperature detecting unit that detects a temperature in the image forming apparatus, wherein, if the humidity that is detected by the humidity detecting unit is greater than or equal to a predetermined threshold humidity, and if the temperature that is detected by the temperature detecting unit is greater than or equal to a predetermined threshold temperature, the changing mechanism is used to make stronger the first attraction force that is generated at the lifting section than if the humidity that is detected by the humidity detecting unit is less than the threshold humidity or the temperature that is detected by the temperature detecting unit is less than the threshold temperature.

7. The image forming apparatus according to claim 3, wherein, if the sheet material that is fed is a coated sheet, the changing mechanism is used to make stronger the second attraction force that is generated at the maintaining section than if the sheet material that is fed is an ordinary sheet.

8. The image forming apparatus according to claim 7, further comprising a humidity detecting unit that detects a humidity in the image forming apparatus and a temperature detecting unit that detects a temperature in the image forming apparatus, wherein, if the humidity that is detected by the humidity detecting unit is greater than or equal to a predetermined threshold humidity, and if the temperature that is detected by the temperature detecting unit is greater than or equal to a predetermined threshold temperature, the changing mechanism is used to make stronger the first attraction force that is generated at the lifting section than if the humidity that is detected by the humidity detecting unit is less than the threshold humidity or the temperature that is detected by the temperature detecting unit is less than the threshold temperature.

9. The image forming apparatus according to claim 7, wherein information regarding a basis weight of the sheet material that is fed is obtained, and, if a basis weight is greater than the obtained basis weight, the changing mechanism is used to make stronger the second attraction force that is generated at the maintaining section.

10. The image forming apparatus according to claim 9, further comprising a humidity detecting unit that detects a humidity in the image forming apparatus and a temperature detecting unit that detects a temperature in the image forming apparatus, wherein, if the humidity that is detected by the humidity detecting unit is greater than or equal to a predetermined threshold humidity, and if the temperature that is detected by the temperature detecting unit is greater than or equal to a predetermined threshold temperature, the changing mechanism is used to make stronger the first attraction force that is generated at the lifting section than if the humidity that is detected by the humidity detecting unit is less than the threshold humidity or the temperature that is detected by the temperature detecting unit is less than the threshold temperature.

11. An image forming apparatus comprising:

the sheet feeding device according to claim 1; and an image forming unit that forms an image on the sheet material that is fed by the sheet feeding device.

12. The image forming apparatus according to claim 11, further comprising a humidity detecting unit that detects a humidity in the image forming apparatus and a temperature detecting unit that detects a temperature in the image forming apparatus, wherein, if the humidity that is detected by the humidity detecting unit is greater than or equal to a predetermined threshold humidity, and if the temperature that is detected by the temperature detecting unit is greater than or equal to a predetermined threshold temperature, the changing mechanism is used to make stronger the first attraction force that is generated at the lifting section than if the humidity that is detected by the humidity detecting unit is less than the threshold humidity or the temperature that is detected by the temperature detecting unit is less than the threshold temperature.

13. The image forming apparatus according to claim 11, wherein information regarding a basis weight of the sheet material that is fed is obtained, and, if a basis weight is greater than the obtained basis weight, the changing mechanism is used to make stronger the second attraction force that is generated at the maintaining section.

14. The image forming apparatus according to claim 13, further comprising a humidity detecting unit that detects a humidity in the image forming apparatus and a temperature detecting unit that detects a temperature in the image forming apparatus, wherein, if the humidity that is detected by the humidity detecting unit is greater than or equal to a predetermined threshold humidity, and if the temperature that is detected by the temperature detecting unit is greater than or equal to a predetermined threshold temperature, the changing mechanism is used to make stronger the first attraction force that is generated at the lifting section than if the humidity that is detected by the humidity detecting unit is less than the threshold humidity or the temperature that is detected by the temperature detecting unit is less than the threshold temperature.

15. The image forming apparatus according to claim 11, wherein, if the sheet material that is fed is a coated sheet, the changing mechanism is used to make stronger the second attraction force that is generated at the maintaining section than if the sheet material that is fed is an ordinary sheet.

16. The image forming apparatus according to claim 15, further comprising a humidity detecting unit that detects a humidity in the image forming apparatus and a temperature detecting unit that detects a temperature in the image forming apparatus, wherein, if the humidity that is detected by the humidity detecting unit is greater than or equal to a predetermined threshold humidity, and if the temperature that is detected by the temperature detecting unit is greater than or equal to a predetermined threshold temperature, the changing mechanism is used to make stronger the first attraction force that is generated at the lifting section than if the humidity that is detected by the humidity detecting unit is less than the threshold humidity or the temperature that is detected by the temperature detecting unit is less than the threshold temperature.

17. The image forming apparatus according to claim 15, wherein information regarding a basis weight of the sheet material that is fed is obtained, and, if a basis weight is greater than the obtained basis weight, the changing mechanism is used to make stronger the second attraction force that is generated at the maintaining section.

18. The image forming apparatus according to claim 17, further comprising a humidity detecting unit that detects a humidity in the image forming apparatus and a temperature detecting unit that detects a temperature in the image forming apparatus, wherein, if the humidity that is detected by the humidity detecting unit is greater than or equal to a predetermined threshold humidity, and if the temperature that is detected by the temperature detecting unit is greater than or equal to a predetermined threshold temperature, the changing mechanism is used to make stronger the first attraction force that is generated at the lifting section than if the humidity that is detected by the humidity detecting unit is less than the threshold humidity or the temperature that is detected by the temperature detecting unit is less than the threshold temperature.

* * * * *